US008201715B2

(12) United States Patent
Park et al.

(10) Patent No.: US 8,201,715 B2
(45) Date of Patent: Jun. 19, 2012

(54) DISPENSER RELATED TECHNOLOGY

(75) Inventors: Joo-Won Park, Busan (KR); Il-Wook Joung, Gyeongsangnam-Do (KR); Byeong-Gyu Kang, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 700 days.

(21) Appl. No.: 12/399,137

(22) Filed: Mar. 6, 2009

(65) Prior Publication Data

US 2009/0249817 A1 Oct. 8, 2009

(30) Foreign Application Priority Data

Apr. 7, 2008 (KR) ..... 10-2008-0032351
Apr. 7, 2008 (KR) ..... 10-2008-0032357

(51) Int. Cl.
*F25C 1/22* (2006.01)

(52) U.S. Cl. ..... 222/504; 222/146.6; 222/108

(58) Field of Classification Search ..... 222/146.6, 222/504, 108, 533–536; 62/340, 344, 389–400
See application file for complete search history.

(56) References Cited

U.S. PATENT DOCUMENTS 4,089,436 A * 5/1978 Marks ..... 222/504
4,090,641 A * 5/1978 Lindenschmidt ..... 222/504
4,227,383 A * 10/1980 Horvay ..... 62/344
6,679,082 B1 * 1/2004 Tunzi ..... 62/344
7,007,500 B2 * 3/2006 Lee ..... 62/389
7,316,121 B2 * 1/2008 Lee et al. ..... 62/344
2004/0231339 A1 * 11/2004 Miozza et al. ..... 62/3.2
2006/0201194 A1 9/2006 Bowen et al.

FOREIGN PATENT DOCUMENTS

KR 869510 B1 11/2008
KR 2009003891 A 1/2009
KR 2009004141 A 1/2009
KR 2009004163 A 1/2009

OTHER PUBLICATIONS

Korean Notice of Allowance issued in Application No. 10-2008-0032351, mailed Apr. 21, 2010, 2 pages.

* cited by examiner

*Primary Examiner* — Kevin P Shaver
*Assistant Examiner* — Donnell Long
(74) *Attorney, Agent, or Firm* — Fish & Richardson P.C.

(57) ABSTRACT

A refrigerator, in which a dispensing unit moves between a received position and a dispensing position and a driving unit is configured to move the dispensing unit from the received position to the dispensing position and is configured to move the dispensing unit from the dispensing position to the received position. The refrigerator also includes a state return unit that is configured to detect a force applied to a cover unit when the dispensing unit is oriented in the dispensing position and that is configured to, in response to detecting the force applied to the cover unit, cause the driving unit to move the dispensing unit from the dispensing position to the received position.

24 Claims, 16 Drawing Sheets

DISPENSER RELATED TECHNOLOGY

CROSS REFERENCE TO RELATED APPLICATIONS

This application claims the benefit of Korean Patent Application No. 10-2008-0032351, filed on Apr. 7, 2008 and Korean Patent Application No. 10-2008-0032357, filed on Apr. 7, 2008, each of which is hereby incorporated by reference for all purposes as if fully set forth herein.

FIELD

The present disclosure relates to dispenser technology.

BACKGROUND

In general, a refrigerator is a device that preserves items, such as food or beverages, in storage in a cool or frozen state by using cool air generated by a refrigerating cycle. A refrigerator may include an ice maker configured to make ice and a dispenser configured to dispense liquid water and ice made by the ice maker.

SUMMARY

In one aspect, a refrigerator having a dispenser includes a cooling compartment and a door configured to open and close at least a portion of the cooling compartment. The refrigerator also includes a dispensing unit that is configured to move between a received position at which a dispenser outlet of the dispensing unit is positioned on a side of a surface of the door where the cooling compartment is positioned and a dispensing position at which the dispenser outlet of the dispensing unit is positioned on a side of the surface of the door opposite of the cooling compartment, and a dispenser receiving structure that defines, within the door, a receiving space in which the dispenser outlet is positioned when the dispensing unit is oriented in the received position and that defines, in the surface of the door, an opening through which the dispenser outlet of the dispensing unit passes when the dispensing unit moves from the dispensing position to the received position. The refrigerator includes a cover unit that is attached to the dispensing unit and that is configured to cover a portion of the opening defined in the surface of the door by the dispenser receiving structure when the dispensing unit is oriented in the received position. The refrigerator further includes a driving unit that is configured to move the dispensing unit from the received position to the dispensing position and that is configured to move the dispensing unit from the dispensing position to the received position, and a state return unit that is configured to detect a force applied to the cover unit when the dispensing unit is oriented in the dispensing position and that is configured to, in response to detecting the force applied to the cover unit, cause the driving unit to move the dispensing unit from the dispensing position to the received position.

Implementations may include one or more of the following features. For example, the state return unit may include a return switch that is actuated by the force applied to the cover unit and that is configured to send a signal to the driving unit in response to being pressed by the force applied to the cover unit. The return switch may be pressed as the dispensing unit is moved to the received position by the force applied to the cover unit.

In some implementations, the dispensing unit may include a guide unit that is attached to a surface of the cover unit positioned closest to the cooling compartment, that defines the dispenser outlet, and that is configured to guide ice through the dispenser outlet when the dispensing unit is oriented in the dispensing position, and a dispensing button unit that is configured to move, in a plane perpendicular to the surface of the door, between a stored position at which the dispensing button unit is positioned on the side of the surface of the door where the cooling compartment is positioned and an extended position at which at least a portion of the dispensing button unit is positioned on the side of the surface of the door opposite of the cooling compartment. The dispensing button unit may be configured to, in the extended position, control dispensing of content through the dispenser outlet in response to manipulation of the dispensing button unit. In these implementations, the state return unit may include a return switch that is positioned within the dispenser receiving structure and pressed by a side of the guide unit when the dispensing unit moves from the dispensing position toward the received position. The dispensing button unit may include a button frame unit that is positioned below the dispensing unit when the refrigerator is oriented in a normal operating orientation and that is configured to move, in the plane perpendicular to the surface of the door, between the stored position at which the button frame unit is positioned on the side of the surface of the door where the cooling compartment is positioned and the extended position at which at least a portion of the button frame unit is positioned on the side of the surface of the door opposite of the cooling compartment, and a button unit that is elastically supported by the button frame unit and that is configured to, when the button frame unit is oriented in the extended position, move, in response to application of force to the button unit, toward the surface of the door from a first position to a second position that is closer to the surface of the door than the first position and move, in response to release of the force applied to the button unit, away from the surface of the door from the second position to the first position.

Further, in some examples, the driving unit may include a driving gear configured to be driven by a motor, a first following gear engaged with the driving gear and configured to rotate the dispensing unit from the received position to the dispensing position in response to the driving gear being driven by the motor, and a second following gear engaged with the driving gear and configured to move the dispensing button unit from the stored position to the extended position in response to the driving gear being driven by the motor. In these examples, the first following gear may have a circular arc shape with a central angle of less than 360 degrees being defined between radial axes extending from a rotation axis of the arc and endpoints of the first following gear periphery. A first end of the first following gear may be connected at the rotation axis, a second end of the first following gear may be connected with the dispensing unit, and the first following gear may be configured to rotate about the rotation axis in response to the driving gear being driven by the motor. In addition, the second following gear may include a sliding unit that extends in a radial direction and comprises a sliding slot configured to receive a sliding protrusion positioned at a side of the dispensing button unit. The sliding unit may be configured to move the dispensing button unit by applying force to the sliding protrusion when the sliding protrusion is received in the sliding slot.

In some implementations, the cover unit may be configured to rotate about an axis of rotation that is above the cover unit when the refrigerator is oriented in a normal operating orientation. In these implementations, the state return unit may include a driving member attached to at least one of the cover unit and the guide unit and rotated with the cover unit and the guide unit when the cover unit and the guide unit move from the dispensing position toward the received position, a following member connected with the driving member and rotated by the driving member, and a return switch that is pressed in response to the rotation of the following member that occurs when the cover unit and the guide unit move from the dispensing position toward the received position. The return switch may be pressed by a pressing portion that extends from an outer circumferential surface of the following member, and the driving member and the following member may be gears engaged with each other.

Also, the following member and the return switch may be received in a casing member provided at one side of the dispenser receiving unit, and a portion of the following member may be exposed from the casing member to enable connection with the driving member. The cover unit may be positioned in a plane of the surface of the door when the dispensing unit is oriented in the received position.

In another aspect, a refrigerator having a dispenser includes a cooling compartment and a door configured to open and close at least a portion of the cooling compartment. The refrigerator also includes a dispensing unit that is configured to move between a received position at which a dispenser outlet of the dispensing unit is positioned on a side of a surface of the door where the cooling compartment is positioned and a dispensing position at which the dispenser outlet of the dispensing unit is positioned on a side of the surface of the door opposite of the cooling compartment, and a button frame unit that is positioned within a receiving space defined within the door when the dispensing unit is oriented in the received position, that is covered by the dispensing unit when the dispensing unit is oriented in the received position, and that is configured to move, in a plane perpendicular to the surface of the door, between a stored position at which the button frame unit is positioned on the side of the surface of the door where the cooling compartment is positioned and an extended position at which at least a portion of the button frame unit is positioned on the side of the surface of the door opposite of the cooling compartment. The refrigerator further includes a button unit that is elastically supported by the button frame unit and that is configured to, when the button frame unit is oriented in the extended position, move, in response to application of force to the button unit, toward the surface of the door from a first position to a second position that is closer to the surface of the door than the first position and move, in response to release of the force applied to the button unit, away from the surface of the door from the second position to the first position, and a driving unit that is configured to guide movement of the button frame unit and that is configured to fix movement of the button frame unit when the button frame unit is oriented in the extended position. The button unit may be configured to cause the dispensing unit to dispense content through the dispenser outlet when the button unit is moved to the second position.

Implementations may include one or more of the following features. For example, the driving unit may include a driving unit frame in which a motor having a driving gear is positioned and a first following gear that is attached to the dispensing unit and that is configured rotate the dispensing unit from the received position to the dispensing position in response to rotation of the driving gear. In this example, the driving unit also may include a second following gear configured to move the button frame unit, in the plane perpendicular to the surface of the door, from the stored position to the extended position in response to rotation of the driving gear, and a lever fixing unit elastically supported by the driving unit frame and configured to fix movement of the second following gear.

In some implementations, the second following gear may include a gear body part engaged with the driving gear and having a guide groove having a certain length in a circumferential direction and a lever unit having a guide protrusion that is inserted in the guide groove and that is configured to be guided along the guide groove. The certain length may be less than a circumference of the gear body part and the lever unit may extend in a radial direction of the gear body part and may connect with the button frame unit such that movement of the lever unit causes movement of the button frame unit. The lever unit may include a sliding slot in which a sliding protrusion positioned at a side of the button frame unit is inserted. The lever unit may be configured to move the button frame unit by applying force to the sliding protrusion when the sliding protrusion is inserted in the sliding slot.

In some examples, the refrigerator may include a pressing unit. The lever fixing unit may restrict movement of the lever unit based on a pressing state of the pressing unit, which may be based on rotation of the gear body part. When the lever unit is at the extended position, the pressing unit may release a pressed state of the lever fixing unit and thereby fix movement of the button frame unit. The lever fixing unit may be positioned at a fixing recess located at a portion of a side of the lever unit to prevent the lever unit from moving from the extended position to the stored position.

In some examples, the diameter of the first following gear may be smaller than the diameter of the second following gear. The first following gear may have a circular arc shape with a central angle of less than 360 degrees being defined between radial axes extending from a rotation axis of the arc and endpoints of the first following gear periphery. A first end of the first following gear may be connected at the rotation axis, a second end of the first following gear may be connected with the dispensing unit, and the first following gear may be configured to rotate about the rotation axis in response to the driving gear being driven by the motor.

In yet another aspect, a refrigerator includes a cooling compartment and a door configured to open and close at least a portion of the cooling compartment. The refrigerator also includes a dispensing unit that is configured to move between a received position at which a dispenser outlet of the dispensing unit is positioned on a side of a surface of the door where the cooling compartment is positioned and a dispensing position at which the dispenser outlet of the dispensing unit is positioned on a side of the surface of the door opposite of the cooling compartment, and a dispenser receiving structure that defines, within the door, a receiving space in which the dispenser outlet is positioned when the dispensing unit is oriented in the received position and that defines, in the surface of the door, an opening through which the dispenser outlet of the dispensing unit passes when the dispensing unit moves from the dispensing position to the received position. The refrigerator further includes a cover unit that is attached to the dispensing unit and that is configured to cover a portion of the opening defined in the surface of the door by the dispenser receiving structure when the dispensing unit is oriented in the received position, and a driving unit that is configured to guide movement of the dispensing unit from the received position to the dispensing position and that is configured to guide movement of the dispensing unit from the dispensing position to the received position.

DETAILED DESCRIPTION

Figure 1:
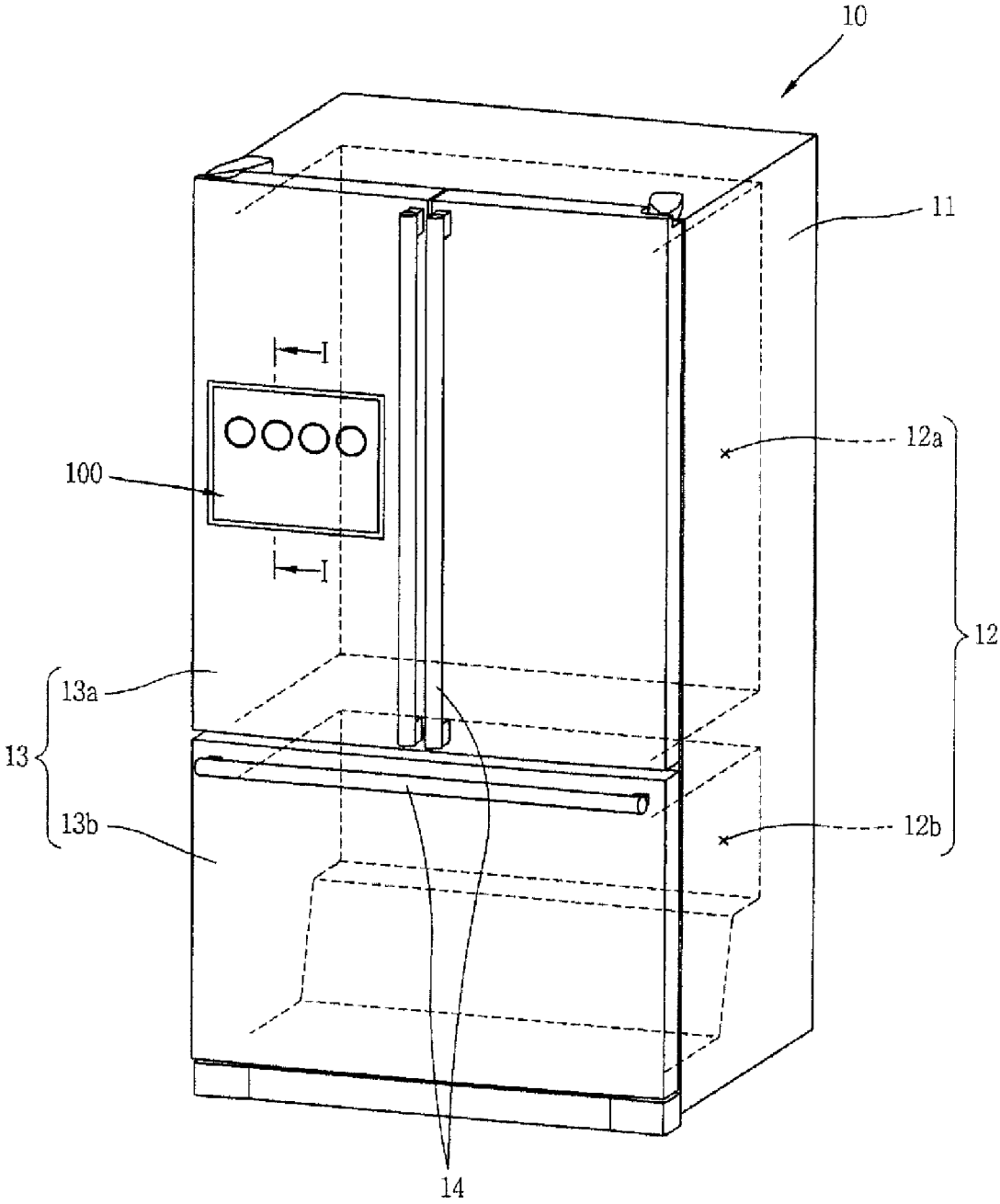
FIG. 1 is a view showing a refrigerator having a dispenser.
Figure 2:
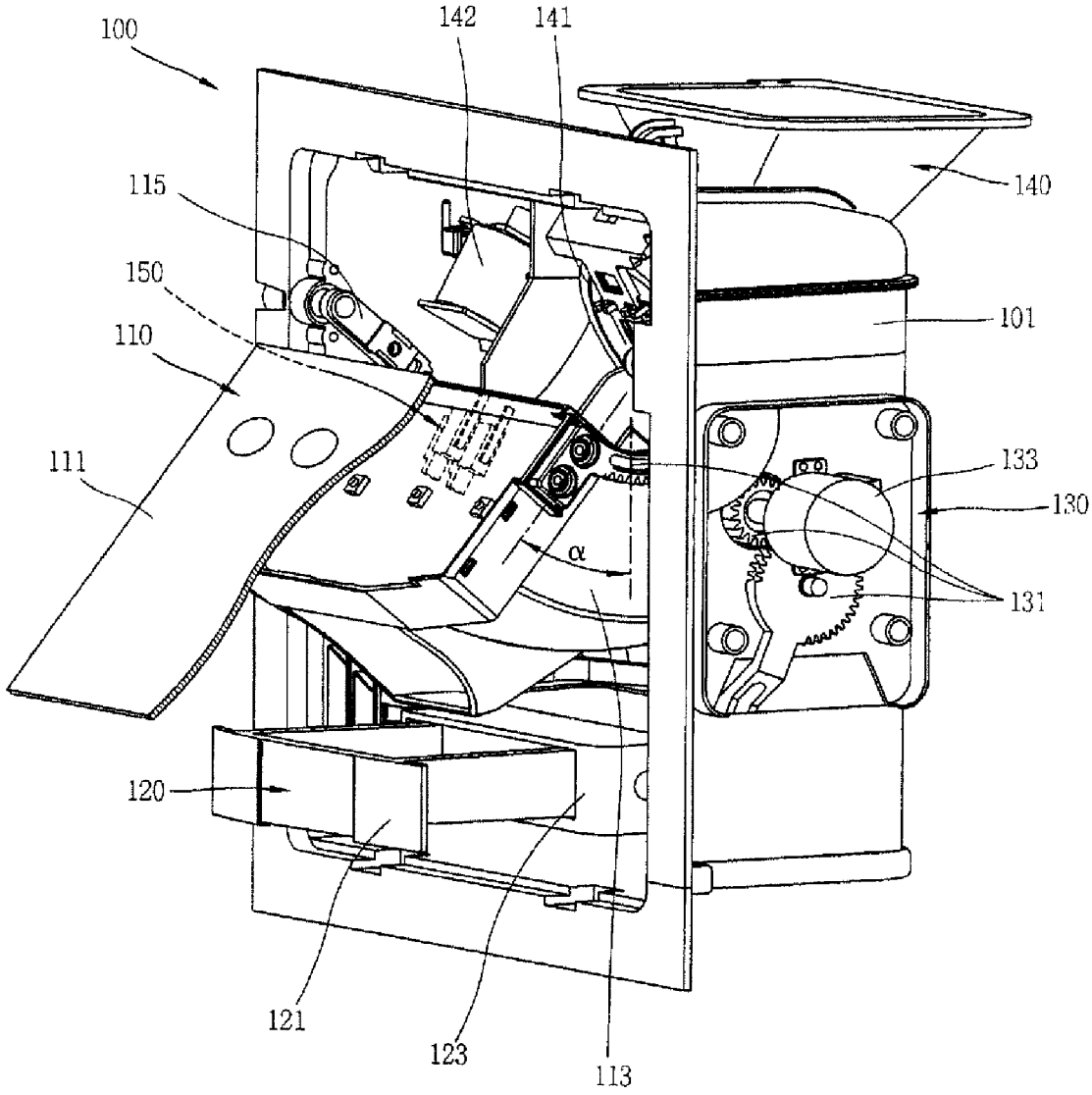
FIG. 2 is a perspective view showing an internal structure of the dispenser in FIG. 1.
Figure 3:
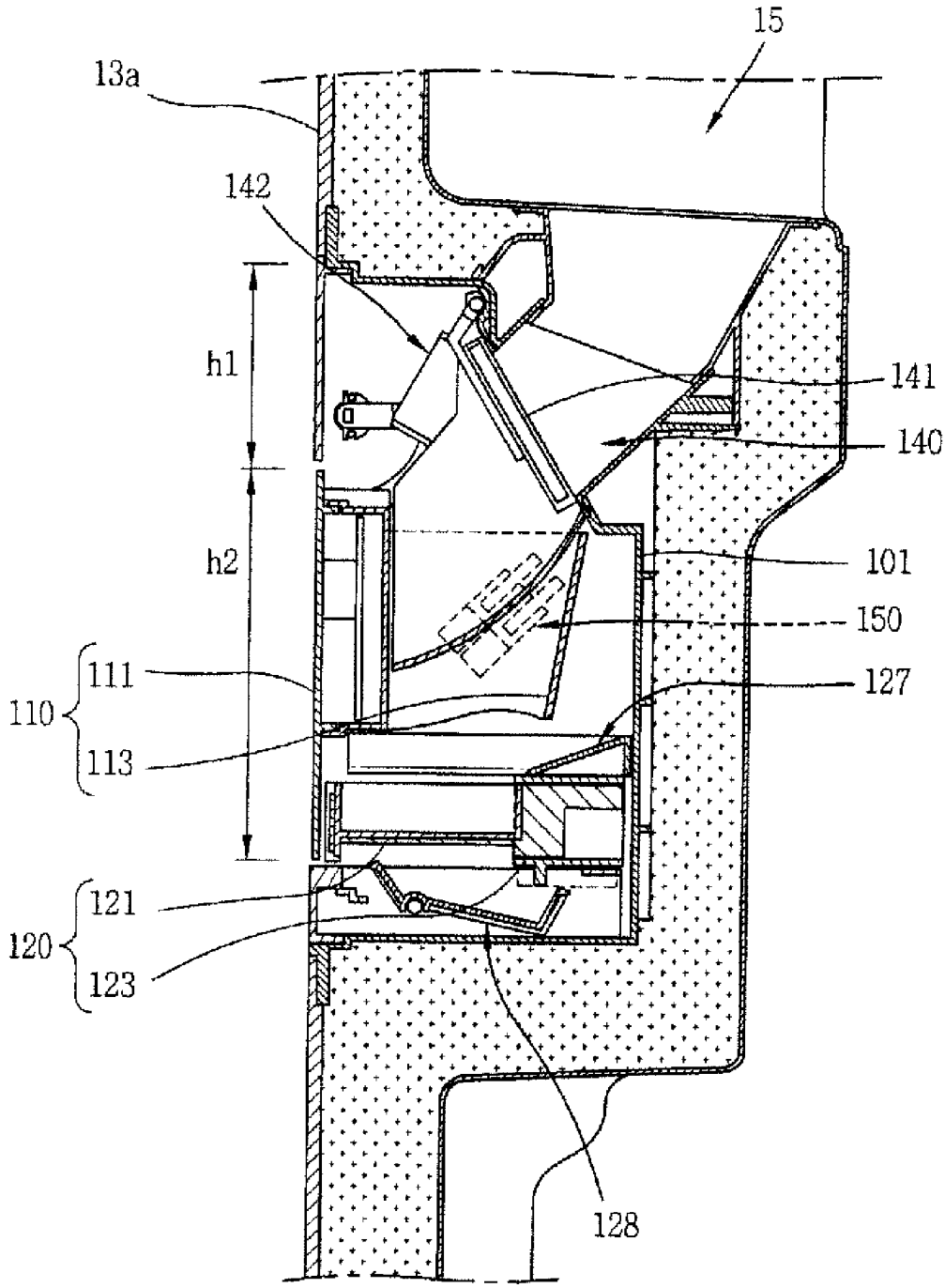
FIG. 3 is a sectional view taken along line I-I in FIG. 1.

FIG. 1 illustrates a refrigerator having a dispenser, FIG. 2 shows an internal structure of the dispenser in FIG. 1, and FIG. 3 illustrates a sectional view of the dispenser taken along line I-I in FIG. 1.

With reference to FIGS. 1 to 3, a refrigerator 10 includes a cooling chamber 12 that stores storage items and a door 13 that shields the cooling chamber.

The cooling chamber 12 is positioned within a main body 11 that defines an external appearance of the refrigerator 10. A gap exists between an inner surface of the cooling chamber 12 and an outer surface of the main body 11, and a heat insulator is positioned within the gap.

The interior of the cooling chamber 12 is insulated from the exterior of the main body 11 by the heat insulator.

Also, one side of the cooling chamber 12 is exposed (e.g., vacant, opened, etc.) to allow items to be put in or taken out, and such one side is covered by a door 13 that is connected to the main body 11 by hinges that enable opening and closing of the door 13.

Because a heat insulator is inserted in the door 13, heat transfer to the cooling chamber 12 via the door 13 can be reduced.

A door handle 14 may be coupled to a portion of a front surface of the door 13 to allow a user to grasp it, and use the door handle 14 to open and close the door 13.

A refrigerating cycle (not shown) for generating cooling air to cool the cooling chamber 12 is provided at one side of the main body 11.

Several mechanisms exist for the construction and operation of the refrigerating cycle, and, therefore, a detailed description on the refrigerating cycle will be omitted. Any of mechanism may be used for the refrigerating cycle of the refrigerator 10.

The cooling air generated by the refrigerating cycle may be supplied to the cooling chamber 12 via a cooling air supply duct (not shown) formed within the main body 11 to cool the interior of the cooling chamber 12.

Of course, an air blower (not shown) may be provided to smoothly supply cooling air through the cooling air supply duct.

The cooling chamber 12 may include a refrigerating chamber 12*a* that freshly keeps storage items in storage without freezing them and a freezing chamber 12*b* that keeps storage items in a frozen state in storage for a long period.

Also, the refrigerating chamber 12*a* and the freezing chamber 12*b* may have various types of specific configurations (or structures) such that consumers may select the configuration they desire based upon how they use their refrigerator or based upon the types or amount of things (food) to be stored therein.

FIG. 1 shows an example of the refrigerator 10 in an ordinary operating orientation. For instance, as shown, when a support structure of the refrigerator 10 rests against the ground, the refrigerating chamber 12*a* is positioned at a relatively upper portion of the main body 11 and the freezing chamber 12*b* is positioned at a relatively lower portion of the main body 11. The ordinary operating orientation may reflect the intended orientation of the refrigerator 10 when being used by a consumer.

In some implementations, as shown in FIG. 1, because users typically access the refrigerating chamber 12*a* more than the freezing chamber 12*b*, the refrigerating chamber 12*a* may be provided at an upper portion and the freezing chamber 12*b* may be provided at a lower portion such that user convenience is improved. Also, a freezing chamber door 13*b* for opening and closing the freezing chamber 12*b* may be a pull-out drawer assembly (instead of a hinged assembly used in the refrigerating chamber door 13*a*) such that the user can place items into or remove items from the freezing chamber 12*b* more easily without having to strenuously bend down (or lower his posture) to access the freezing chamber 12*b*.

Alternatively, the freezing chamber 12*b* may be formed at the upper portion and the refrigerating chamber 12*a* may be formed at the lower portion. Of course, the refrigerating chamber 12*a* and the freezing chamber 12*b* may be horizontally oriented and positioned side by side.

A dispenser 100 is provided on the refrigerator 10 to dispense ice or the like made in the cooling chamber 12 from the exterior without opening the door 13.

FIG. 1 shows an example in which the dispenser 100 is provided on the refrigerating door 13*a*, but alternatively, the dispenser 100 may be provided on the freezing chamber door 13*b*.

With reference to FIGS. 2 and 3, an ice making unit 15 may be provided within the cooling chamber 12 to make ice or the like to be dispensed via the dispenser 100, and the ice making unit 15 and the dispenser 100 may be installed to be connected with each other.

For this, the ice making unit 15 and the dispenser 100 are connected with each other, and a transfer unit 140 may be provided to transfer ice or the like made by the ice making unit 15 to the dispenser 100.

The ice making unit 15 may be provided within the cooling chamber 12 or on the rear surface of the door 13, namely, the surface facing the cooling chamber 12.

The construction and the operation of the ice making unit 15 may be the same as those of known ice making units, so its detailed description will be omitted.

In some implementations, the dispenser 100 includes a dispenser receiving part 101 positioned at the door 13, a dispensing unit 110 received in the dispenser receiving part 101 and capable of being ejected, a cover unit 111 that shields the dispenser receiving part 101 when the dispensing unit 110 is at a received position, and a driving unit 130 that stows or deploys the dispensing unit 110.

Also, the dispenser 100 further includes a state return unit 150 that detects an external force applied to the cover unit 111 when the dispensing unit 110 is in an ejected (projected) state (e.g., a dispensing position), and causes the dispensing unit 110 to move from the dispensing position to the received position.

The dispenser receiving part 101 is positioned at a recessed portion of the door 13. The dispenser receiving part 101 may include an opening on the front surface of the door 13.

In this example, the opening may have the same size as the recessed area of the dispenser receiving part 101, and in this case, the overall area of the opening may be sufficient to accommodate a dispensing unit 110 (described hereafter) that will be opened or closed, while reducing any detrimental effects to the external appearance (aesthetics) of the dispenser 100. Thus, the area of the opening may be smaller than the recessed portion of the dispenser receiving part 101.

The dispensing unit 110 is positioned in the dispenser receiving part 101 such that it is received into an interior of the opening of the dispenser receiving part 101 when the dispensing unit 110 is in the received position and ejected in front of the door 13 via the opening when the dispensing unit 110 is moved from the received position to the dispensing position.

When the dispensing unit 110 is moved from the dispensing position to the received position, the dispensing unit 110 is received in the interior through the opening of the dispenser receiving part 101, and housed in the interior of the dispenser receiving part 101 such that it may be ejected forwardly from the door 13 through the opening.

The dispensing unit 110 includes a guide unit 113 that guides dispensing of ice or the like, a dispensing button unit 120 that initiates dispensing of ice or the like, and a driving unit 130 that drives the receiving and ejecting operations of the guide unit 113 and the dispensing button unit 120.

The cover unit 111 is attached to the front surface of the guide unit 113 and ejected together with the dispensing unit 110 when the dispensing unit 110 is ejected, and covers the opening of the dispenser receiving part 101 when the dispensing unit 110 is received.

The guide unit 113 and the cover unit 111 attached thereto may be referred to as the dispensing unit 110, and the configuration of the dispensing unit 110 will be described in more detail below.

A transfer unit 140 may be provided at an upper side of the dispenser receiving part 101, allowing an outer side and an inner side of the dispenser receiving part 101 to communicate with each other.

An opening/closing member 141 for selectively opening the transfer unit 140 when ice or the like needs to be transferred via the transfer unit 140 may be provided at an inner side of the transfer unit 140. One side of the opening/closing member 141 may be hinge-connected with the transfer unit 140 or with the dispenser receiving part 101 and may be rotated by a driving unit such as a solenoid 142.

Figure 4:
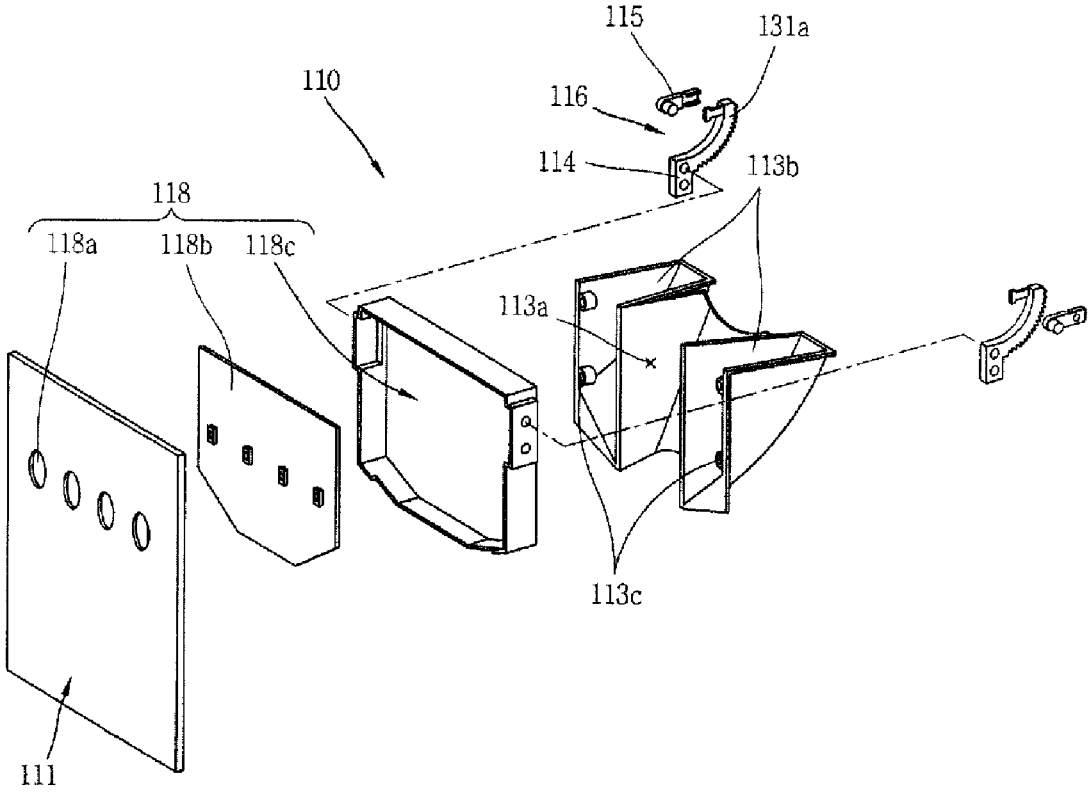
FIG. 4 is an exploded perspective view showing a dispensing unit.

FIG. 4 illustrates a dispensing unit.

As shown in FIG. 4, in some implementations, the dispensing unit 110 includes the cover unit 111 and the guide unit 113 that is attached to the rear surface of the cover unit 111 and that guides dispensed ice or the like as described above.

Both ends of the upper portion of the dispensing unit 110 are connected by hinges with both sides of the inner surface of the dispenser receiving part 101 so as to be rotatable in a vertical direction (up and down).

In detail, the dispensing unit 110 is rotated upwardly so as to move to the dispensing position at which the dispensing unit 110 is ejected forwardly from the door 13, and is rotated downwardly so as to move to the received position at which the dispensing unit 110 is received into the dispensing receiving unit 101.

The guide unit 113 is connected with an end of the transfer unit 140 at the dispensing position to guide ice or the like to be dispensed therethrough.

The guide unit 113 includes a guide 113*a* for guiding dispensed ice or the like and guide fixing units 113*b* positioned at both sides of the guide 113*a* and having fastening units 113*c* fasten the guide unit 113 with the cover unit 111.

One end of a hinge connecting member 116 that couples the dispensing unit 110 to the dispenser receiving part 101 is fixed to a side surface of the dispensing unit 110, namely, to both sides of the cover unit 111 or the guide unit 113, and the other end of the hinge connecting member 116 is coupled with the dispenser receiving part 101.

The hinge connecting member 116 rotates the dispensing unit 110 upon receiving power from the driving unit 130. The hinge connecting member 116 is described in more detail below.

As shown in FIG. 3, the guide unit 113 is positioned to overlap with the transfer unit 140 at the received position. Accordingly, a space taken by the dispensing unit 110 at the received position may be reduced.

In addition, the cover unit 111 is positioned on the same plane (level) of the front surface of the door 13 and provided to shield the opened front side of the dispenser receiving part 101 when at the received position.

In some implementations, the opened front of the dispenser receiving part 101 may have a particular height (h2) (See FIG. 3), which is measured from the upper end of the cover unit 111 to the lower end of the dispensing button unit 120 provided under the dispensing unit 110, such that the dispensing unit 110 is allowed to be opened and closed and that the dispensing button unit 120 may be pressed (or pushed).

Accordingly, a dispenser receiving unit 101 may be used as a separate additional element that provides shielding (e.g., blocking, covering, etc.) between the bottom end of the transfer unit 140 and the upper portion of the cover unit 111 (h1, See FIG. 3)

Preferably, a hinge connecting portion 115 to which the dispensing unit 110 is coupled is positioned to be higher by a certain length than the upper end of the dispensing unit 110.

Accordingly, the rotation radius of the dispensing unit 110 may be increased without extending the height of the cover unit 111, and thus, the protruding length of the end of the guide unit 113 may be increased at the dispensing position.

Thus, the user may take out ice or water using the dispenser 100. In addition, because a rotation angle of the dispensing unit 110 is reduced, the dispensing unit does not need to be excessively rotated to degrade an aesthetic external appearance in the dispensing operation.

In some examples, in order to reduce detrimental effects of the aesthetic external appearance at the dispensing position, the angle ($\alpha$) between the cover unit 111 and the front surface of the door 13 is maintained within the range of about 45° to 60°.

As shown in FIGS. 1-3, the dispensing unit 110 and the dispensing button unit 120 are ejected in front of the door 13 by a driving unit 130 to dispense ice from the cooling chamber 12. Because the dispensing unit 110 and the dispensing button unit 120 are ejected in front of the door 13 by the driving unit 130 to dispense ice from the cooling chamber, the space taken by the dispenser 100 may be reduced (e.g., minimized), and accordingly, a reduction in the volume of the cooling chamber 12 caused by the dispenser may be reduced (e.g., minimized).

Referring again to FIG. 4, the dispensing unit 110 may include a control button unit 118 that controls the operation of the dispenser 100. The control button unit 118 includes a button PCB (Printed Circuit Board) 118*b* that generates a control signal when pressed by the user, a button receiving unit 118*a* positioned at the cover unit 111 and configured to transfer a pressing force to the button PCB 118*b*, and a PCB receiving unit 118*c* in which the button PCB 118*b* is received and fixed.

The control button unit 118 is attached to a rear surface of the cover unit 111 and the guide unit 113 is attached to a rear surface of the control button unit 118.

Figure 5:
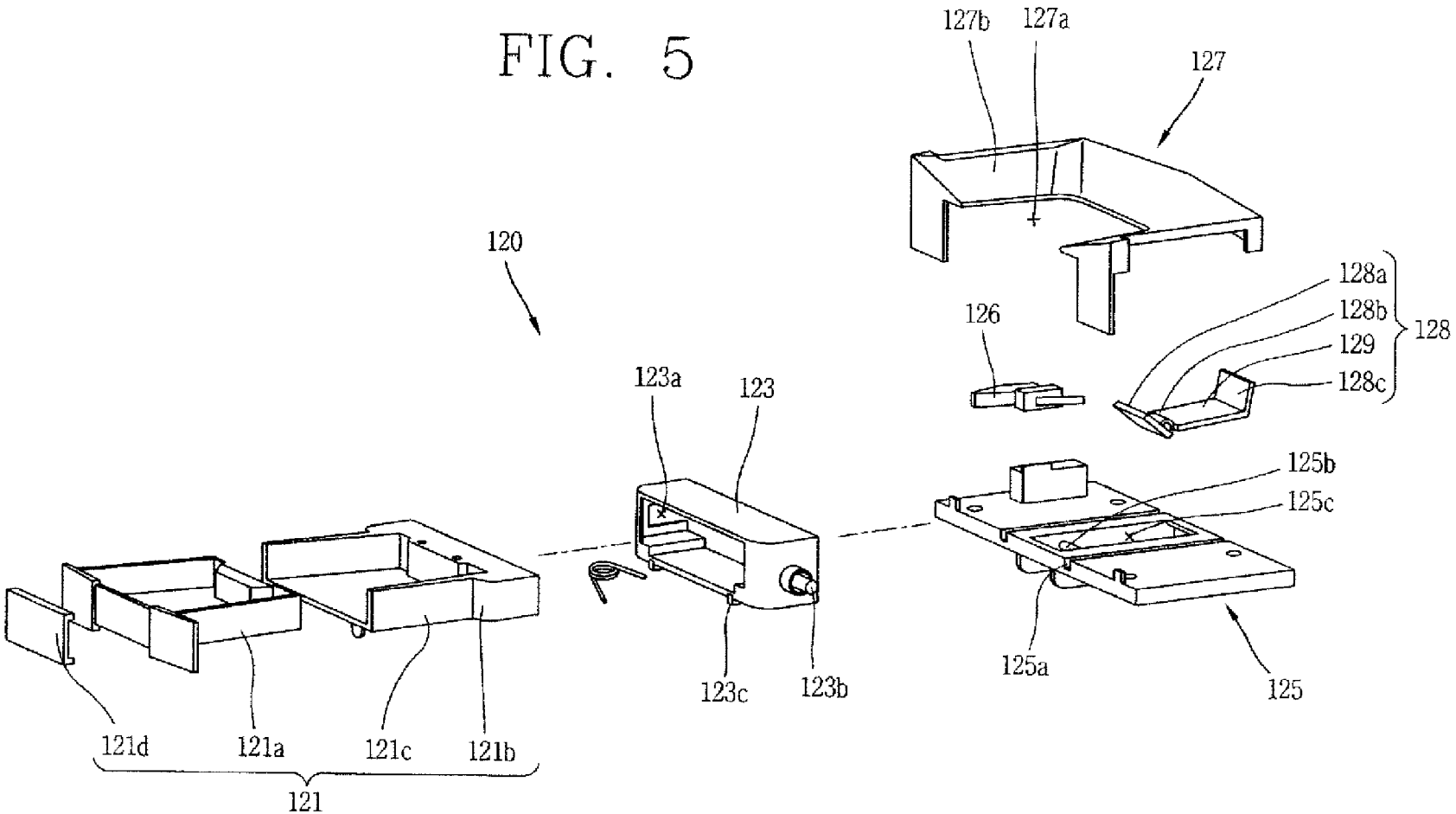
FIG. 5 is an exploded perspective view of a dispensing button unit.

FIG. 5 illustrates a dispensing button unit.

As shown in FIG. 5, in some implementations, the dispensing button unit 120 includes a button frame unit 123 that horizontally moves in or out of the dispenser receiving part 101 by cooperatively operating with a movement of the cover unit 111 or the guide unit 113 by the driving unit 130 and a button unit 121 elastically supported by the button frame unit 123 and initiating a dispensing operation.

The dispensing button unit 120 is positioned below the guide unit 113. Thus, when the button unit 121 is pressed or pushed in by using a container (or cup) being held by a user, the lip (or opening) of the container (or cup) may be aligned with a bottom edge of the guide unit 113.

The dispensing button unit 120 may further include a frame movement guide unit 125 that guides a horizontal movement of the button frame unit 123 and reduces lateral movement of the button frame unit 123.

The button unit 121 is supported by the button frame unit 123 in an elastic manner due to a restoring force that is biased in a forward direction with respect to the dispenser receiving part 101.

Thus, in order to limit movement of the button unit 121 forwardly of the dispenser receiving part 101 by the restoring force, a stop end 121*b* is positioned at a rear end of the side of the button unit 121 and a button unit stop recess 123*a* is positioned at the side of the button frame unit 123 such that it corresponds to the stop end 121*b*.

The stop end 121*b* and the button unit stop recess 123*a* may be installed on any portion of the upper or lower surfaces without being limited to the side.

A dispense switching member 126 is installed on a movement path along which the rear end of the side of the button unit 121 moves, and pressed by the movement of the button unit 121 to generate an operation signal of the dispenser 100.

In this case, the dispense switching member 126 may be fixedly provided on an inner side of the dispenser receiving part 101.

Alternatively, the dispense switching member 126 may be fixed to the frame movement guide unit 125. In this example, the lateral movement of the button frame unit 123 may be reduced by the frame movement guide unit 125, thereby enhancing contact reliability between the button unit 121 and the dispense switching member 126.

The frame movement guide unit 125 is positioned on a lower surface of the button frame unit 123 and fixed to a lower surface of an inner side of the dispenser receiving part 101. On the contact surfaces of the frame movement guide unit 125 and the button frame unit 123, a button guiding protrusion 123*c* and a button guiding groove 125*a* are provided in a corresponding manner in the movement direction of the button frame unit 123.

The button frame unit 123 allows the button unit 121 to be inserted and elastically supported therein, and a sliding protrusion 123*b* is positioned at an outer side of the button frame unit 123 and coupled with the driving unit 130 to drive the horizontal movement of the button frame unit 123.

The button unit 121 further includes a residual ice (or water) receiving unit 121*a* that is depressed from an upper surface of the button unit 121 toward the lower surface thereof and that is separably movable. The button unit 121 includes a button body 121*c* to which the residual ice receiving unit 121*a* is detachably mounted.

The dispensing button unit 120 further includes a residual ice guide unit 127 that is positioned at an upper side of the dispensing button unit 120 and guides ice or the like which is abnormally dispensed from the guide unit 113 to the residual ice receiving unit 121*a*.

For example, the residual ice guide unit 127 includes an opening 127*a* to allow ice to be transferred at an inner side thereof and a slope portion 127*b* configured to be downwardly sloped at the circumference of the opening 127*a* to guide ice dispensed to the opening 127*a*.

In some implementations, the opening 127*a* of the residual ice guide unit 127 is fixed at a certain position of an upper portion of the dispensing button unit 120 such that it corresponds to the residual ice receiving unit 121*a* when the button unit 121 is pressed.

Accordingly, if the residual ice receiving unit 121*a* is filled with much residual ice (or water), the user may release the residual ice receiving unit 121*a* to remove the internal residual ice (or water).

In some examples, a container contact unit 121*d* may be provided as an elastic member on the front surface of the residual ice receiving unit 121*a*, namely, on the face where the container for receiving ice, water, or the like contacts in order to reduce the amount of impact transferred to the container by the restoring force applied to the button unit 121 when the button unit 121 is pressed.

Also, the button unit 121 may have a maximum pressed position that is determined by a button movement restricting unit 128 positioned to face the rear surface of the button unit 121 according to the movement of the button frame unit 123.

Accordingly, upon pressing (or pushing) the button unit 121 to dispense ice, water, or the like, the user can realize that the button unit 121 has been pressed to its maximum position (by virtue of the container contact unit 121*d*).

Ice or the like dispensed through the guide unit 113 as the button unit 121 is pressed may be received in the container, and in this case, if the maximum pressed position of the button unit 121 is not restricted, the ice or the like may not be retrieved in the container and may spill.

Thus, the button movement restricting unit 128 may allow a stable dispensing operation that removes such problem.

The button movement restricting unit 128 includes a hinge portion 129 coupled in a horizontal direction at a lower portion of the dispensing button unit 120, first and second extending portions 128*a* and 128*b* that extend to the front or rear sides of the dispensing button unit 120 upwardly with respect to a horizontal surface from the hinge portion 129, and a third extending portion 128*c* that is angled from an end of the second extending portion 128*b* and positioned to face the rear surface of the button unit 121 at the dispensing position.

An installation recess 125*c*, in which the button movement restricting unit 128 is installed, may be provided at the button frame guide unit 113 in a corresponding manner, and a coupling hinge unit 125*b* may be horizontally provided in the installation recess 125*c*.

Figure 6:
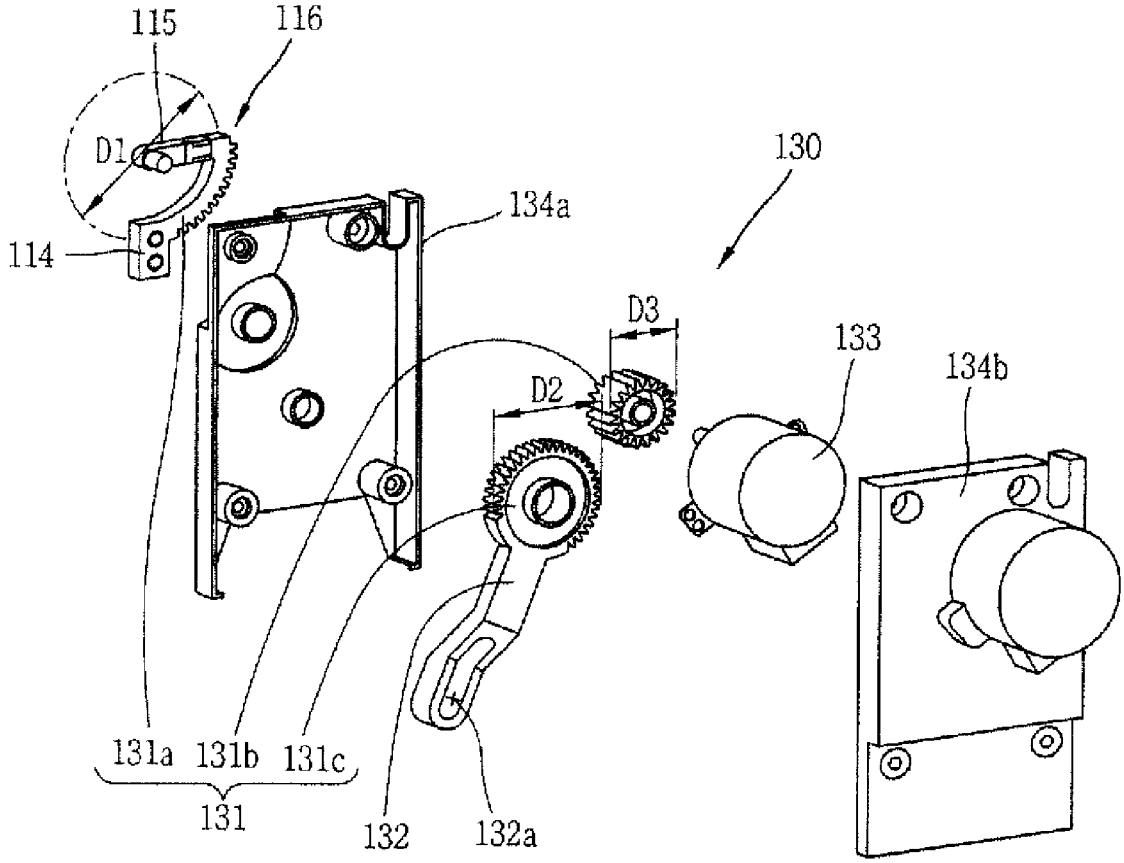
FIG. 6 is an exploded perspective view of a driving unit.
Figure 7:
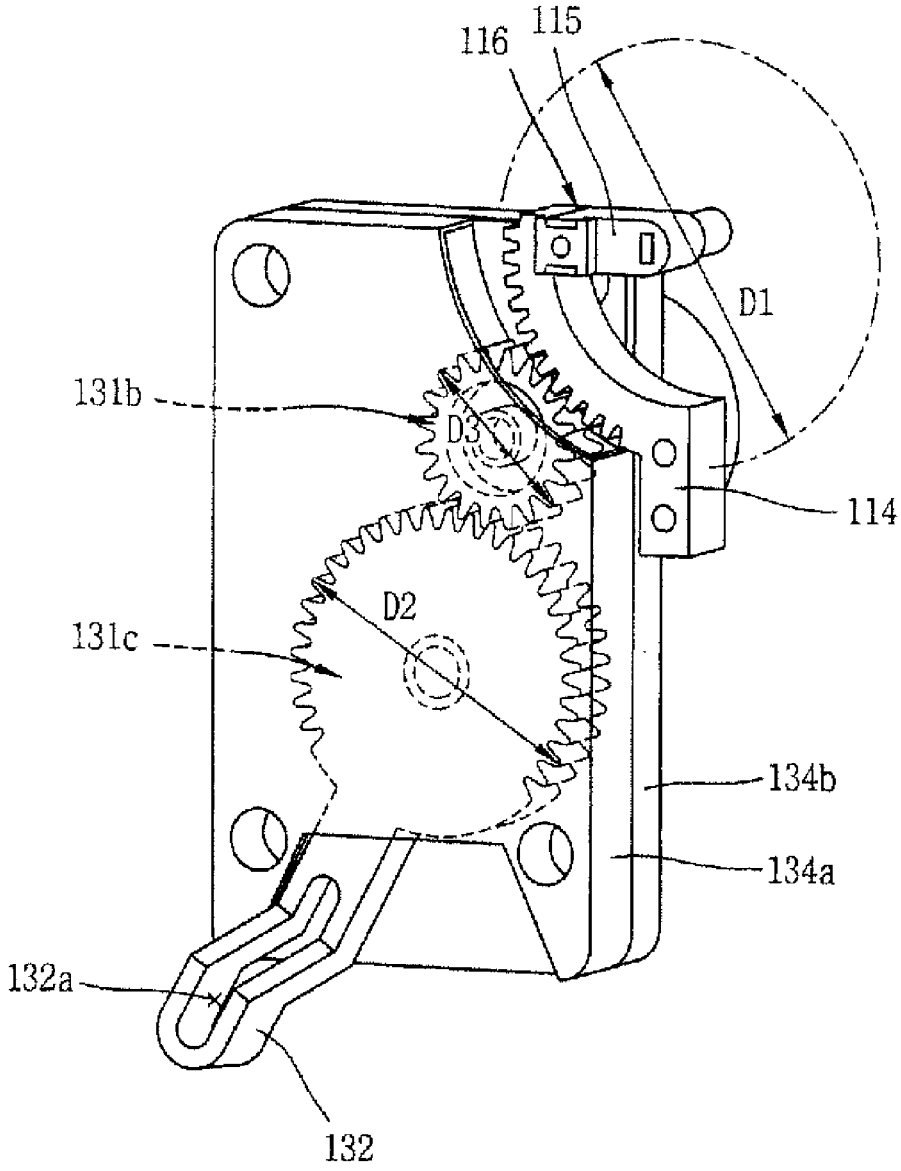
FIG. 7 is a perspective view of an assembled state of the driving unit in FIG. 6.

FIG. 6 illustrates a driving unit, and FIG. 7 shows an assembled state of the driving unit in FIG. 6.

With reference to FIGS. 6 and 7, in some implementations, as described above, the driving unit 130 includes the gear unit 131 having a plurality of gears connected with the dispensing unit 110 and the dispensing button unit 120 and the motor 133 for transferring power to the gear unit 131.

The gear unit 131 includes a driving gear 131*b* that is coupled with the motor 133 such that the driving gear 131*b* rotates in response to force applied by the motor 133, a first following gear 131*a* that is coupled with the driving gear 131*b* to rotate the dispensing unit 110, and a second following gear 131*c* that is coupled with the driving gear 131*b* to move the dispensing button unit 120.

Here, the driving gear 131*b*, the first following gear 131*a*, and the second following gear 131*c* may be installed such that their rotation surfaces are perpendicular to the cover unit 111 (as can be seen from the Figures).

In some examples, a diameter D1 of the first following gear 131*a* is smaller than a diameter D2 of the second following gear 131*c*. In these examples, the angular velocity of the first following gear 131*a* is larger than that of the second following gear 131*c* according to the rotation of the driving gear 131*b*, so there is a difference between an ejecting speed of the dispensing unit 110 and that of the dispensing button unit 120. This arrangement may reduce a problem of the movement of the dispensing button unit 120 being interfered with by the cover unit 111.

In addition, the diameter D3 of the driving gear 131*b* may be smaller than the diameters D1 and D2 of the first following gear 131*a* and the second following gear 131*c*.

The driving gear 131*b* is rotated by the motor 133 and enabling the rotation of the driving gear 131*b* to be maintained at a relatively low speed may allow for the dispensing unit 110 and the dispensing button unit 120 to be smoothly ejected or retracted with minimal noise. The use of a motor having a low rotation speed, however, may be costly and complicated.

Thus, by allowing the driving gear 131*b* to have a smaller diameter, the ejecting speed of the dispensing unit 110 and the dispensing button unit 120 may be reduced by using a rotation speed ratio.

The driving gear 131*b*, the second following gear 131*c* and the motor 133 are positioned within the first and second cover units 134*a* and 134*b* which are matched to connect with each other, and a portion of the driving gear 131*b* is exposed through one portion of the first cover unit 134*a*, where the first following gear 131*a* is engaged.

The first following gear 131*a* is connected with the hinge connecting portion 115 and a fixing portion 114 to constitute the hinge connecting member 116. The hinge connecting member 116 has a circular arc shape with a certain central angle. One end of the first following gear 131*a* is connected with the hinge connecting portion 115, which is connected with the dispenser receiving part 101, and the other end thereof is connected with the fixing portion 114.

The certain central angle may be larger than the angle ($\alpha$) at which the cover unit 111 moves.

The fan-shaped internal space defined by connection of the hinge connecting potion 115 and the first following gear 131*a* serves to prevent an upper end of the cover unit 111 from being interfered with by a lower end of a front portion 101*a* of the dispenser receiving part 101 when the dispensing unit 110 is rotatably ejected.

The hinge connecting member 116 may be coupled with one of the side portions of the dispensing unit 110, in order to support rotation of the dispensing unit 110, and an idle gear 138 engaged with the hinge connecting member 116 may be further installed at the side of the dispenser receiving unit 110 to provide increased stability.

The second following gear 131*c* includes a sliding lever portion 132 extending in a radius direction and driving a horizontal movement of the button frame unit 123.

The sliding lever portion 132 includes a sliding slot 132*a* in a lengthwise direction, and a sliding protrusion 123*b* extending from the side of the button frame unit 123 is inserted into the sliding slot 132*a*.

Accordingly, the sliding lever portion 132 pushes the sliding protrusion according to the rotation of the second following gear 131*c*, and in response to rotation of the second following gear 131*c*, the sliding protrusion 123*b* is horizontally moved along the sliding slot 132*a*.

Figure 8:
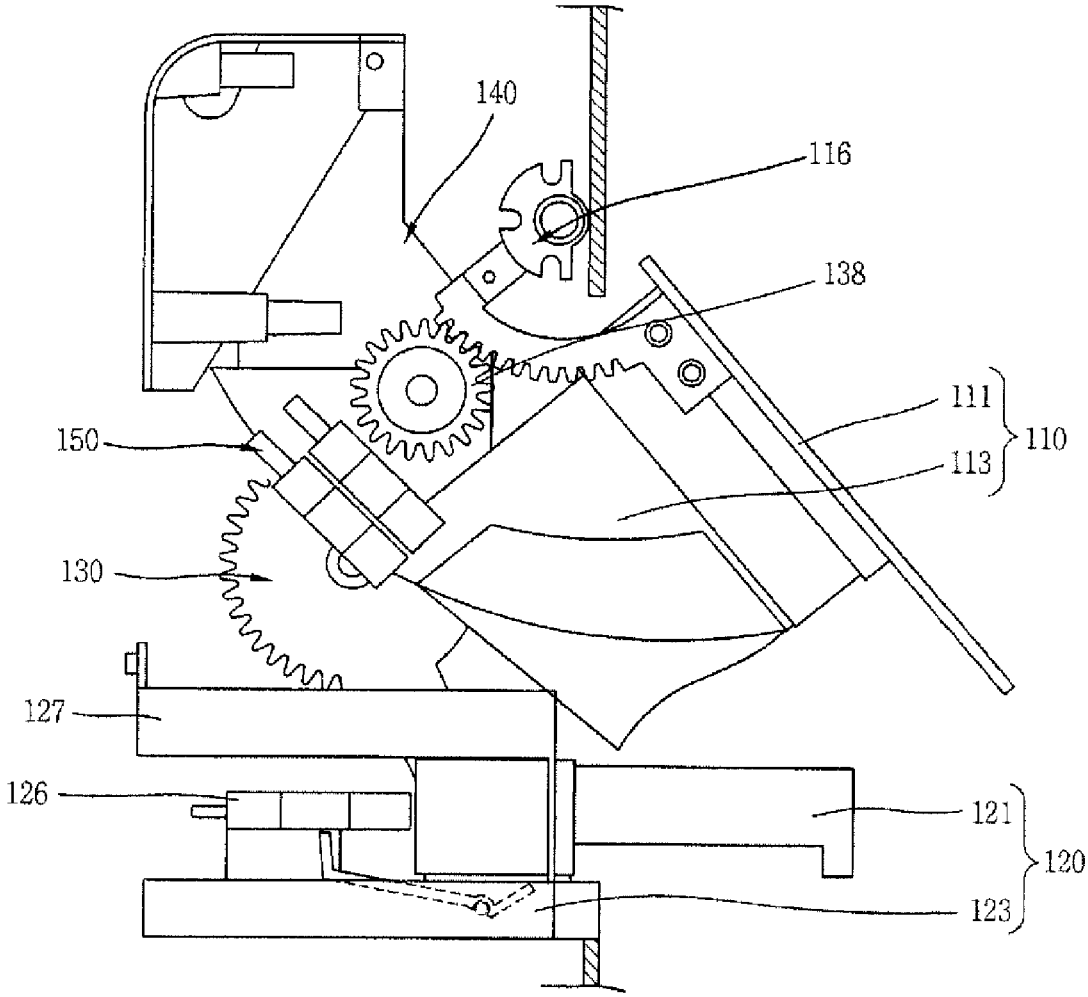
FIG. 8 is a side view showing a position relationship of a state return unit and a dispensing unit.

FIG. 8 shows a position relationship of a state return unit and a dispensing unit.

With reference to FIG. 8, the state return unit 150 is installed at a side of the dispenser receiving unit 103, and includes a return switch that is positioned to be pressed by the side of the guide unit 113 when the guide unit 113 moves from the dispensing position to the received position.

The return switch is provided on a movement path of the side of the guide unit 113 such that the return switch remains pressed by the side of the guide unit 113 when the dispensing unit 110 is moved from the dispensing position to the received position.

In addition, the return switch is positioned such that it contacts at an early stage of movement of the dispensing unit 110 from the dispensing position to the received position.

Accordingly, if the dispensing unit 110 at the dispensing position is pressed toward the received position due to an external force applied to the dispensing unit 110, the driving unit 130 is driven to automatically return the dispensing unit 110 to the received position.

At this time, the dispensing of ice or the like may be stopped as the return switch is pressed.

Meanwhile, in a state in which the dispensing of ice or the like through the dispenser 100 is completed, the user may press the dispensing unit 110, without pressing the control button unit 118 to move the dispenser 100 to the received position.

Figure 9:
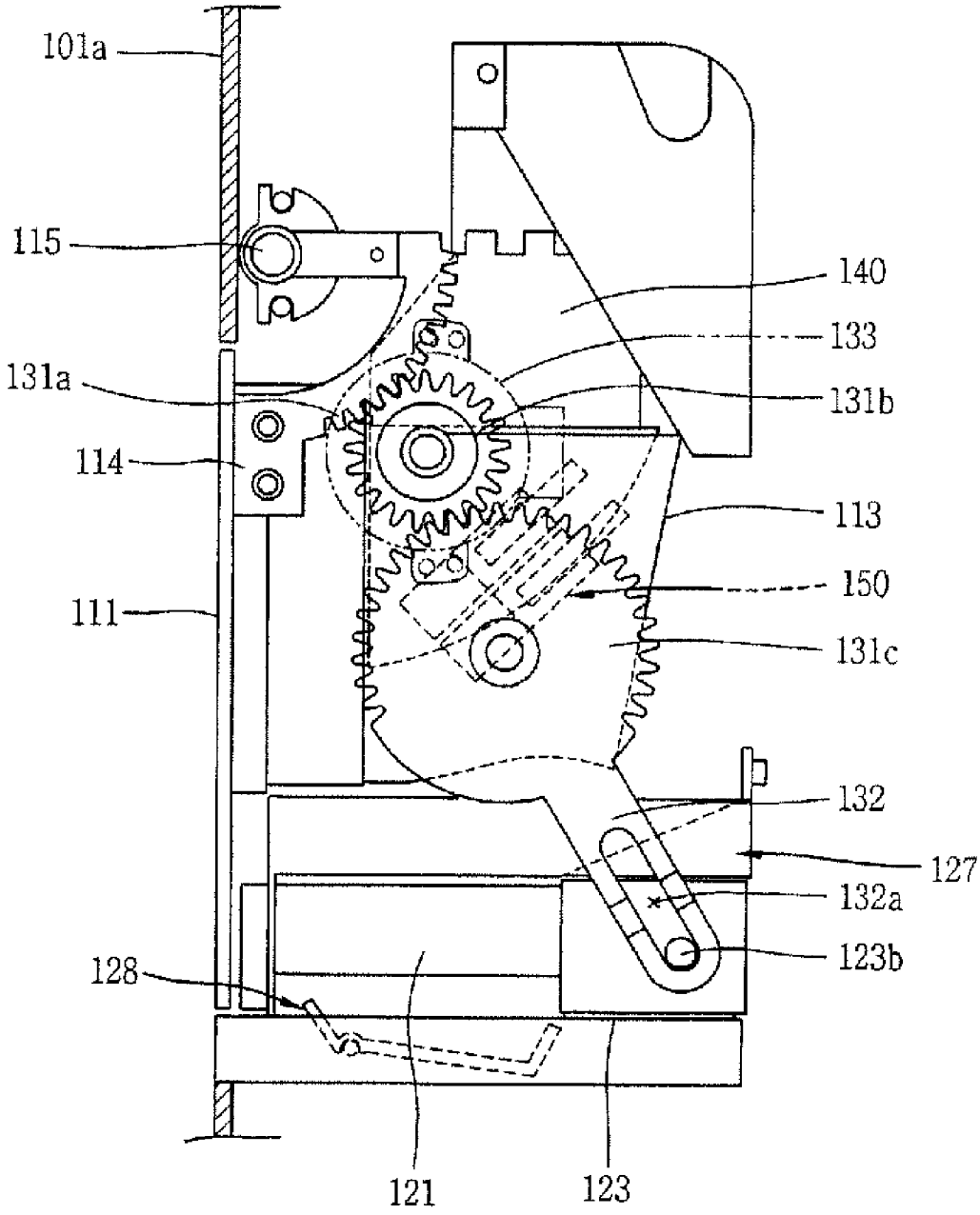
FIG. 9 is a side view of the dispenser at a received position.
Figure 10:
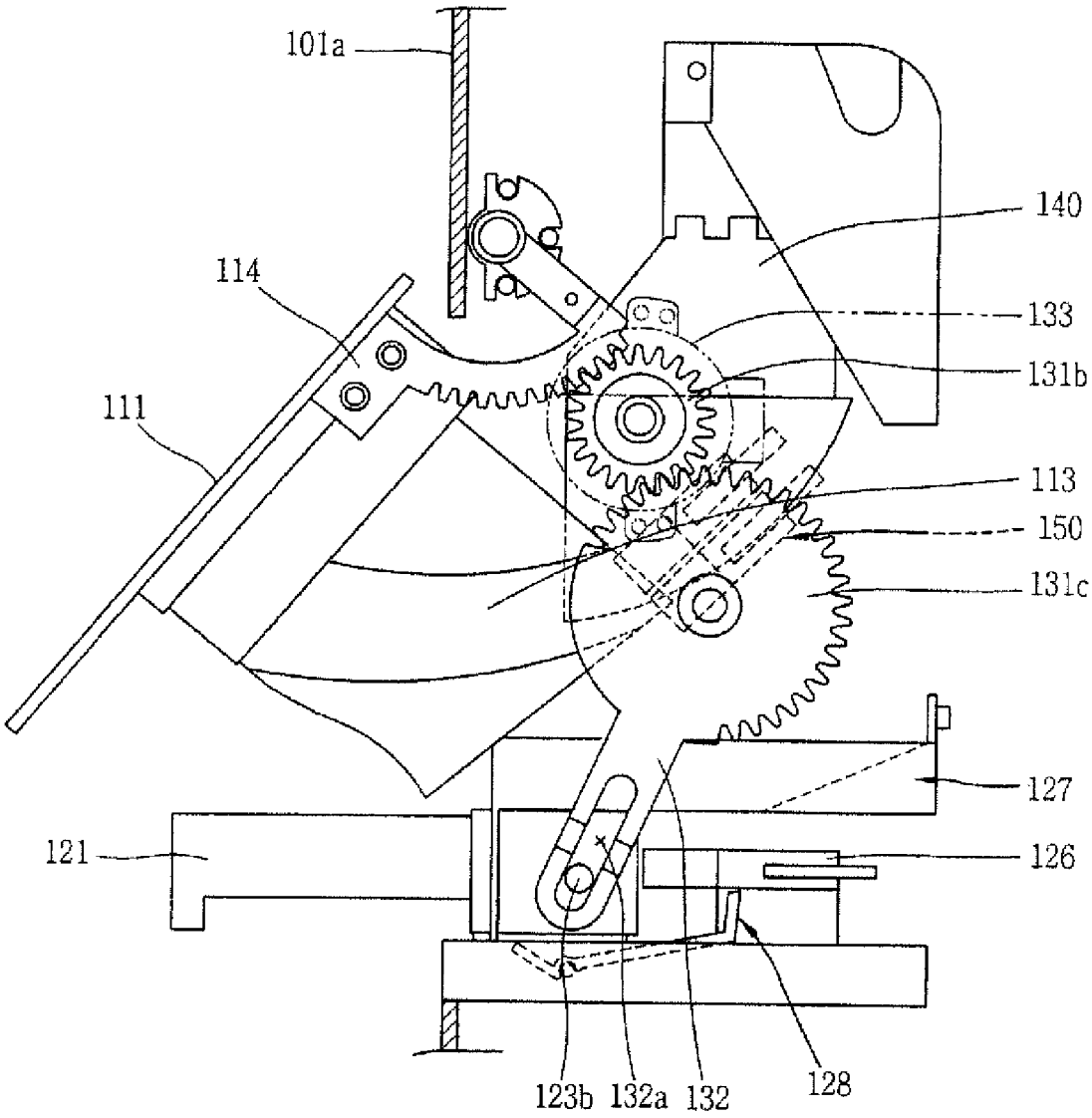
FIG. 10 is a side view of the dispenser at a dispensing position.

FIG. 9 shows a dispenser oriented at a received position, and FIG. 10 shows a dispenser oriented at a dispensing position.

With reference to FIGS. 9 and 10, according to some implementations, the dispenser 100 is completely shielded by the cover unit 111 at the received position of the door 13 when viewed from an outer side of the refrigerator 10. As such, when the dispenser is not in use, the dispensing unit and the dispensing button unit are received at the inner side of the door and shielded by the cover unit, so that contamination, by dust, etc., of the dispensing unit and the dispensing button unit may be reduced (e.g., prevented). Moreover, when the dispenser is not in use, the cover unit is positioned on the same plane as the front surface of the door, shielding the interior, so that the external appearance of the refrigerator may be aesthetically improved.

As shown in FIG. 10, when the dispenser is in the received position, the guide unit 113 is positioned to overlap with the transfer unit 140, and the dispensing button unit 120 is received to the inner side of the dispenser receiving part 101 by the sliding lever portion 132.

In the received position, when an input signal of the user is transferred via the control button unit 118 provided at the cover unit 111, the driving gear 131*b* is rotated counterclockwise based on the illustration in FIG. 10 by the motor 133 and the first following gear 131*a* and the second following gear 131*c*, which are coupled with the driving gear 131, are rotated clockwise, respectively.

Accordingly, the cover unit 111 and the guide unit 113 are rotated based on the hinge connecting portion 115 as a central shaft and thereby ejected from the dispenser receiving part 101.

Also, the sliding protrusion 123*b* positioned at the button frame unit 123 is horizontally moved, along the sliding slot 132*a* formed at the sliding lever unit 132, to the front side of the dispenser receiving part 101.

Thereafter, when the button unit 121 is pressed by the user, the switching member 126 positioned on the movement path of the button unit 121 is pressed by the button unit 121 to generate an ice dispense signal, a water dispense signal, or the like.

Accordingly, ice, water, or the like is transferred through the transfer unit 140 and dispensed externally through the guide unit 113.

When the dispenser is in the dispensing position, if an external force is applied to the dispensing unit 110 toward the received position, the state return unit 150 is pressed, and accordingly, the dispensing unit 110 is returned to the received position by the driving unit 130.

In this example, the external force may have no connection with the user input that controls the dispensing operation, but may be an external force applied by the user to the dispensing unit 110, instead of the control button unit 118, to move the dispenser 100 to the received position when the dispensing of ice, water, or the like is completed.

The movement from the dispensing position (opened configuration) to the received position (closed configuration) is the opposite to that of the dispensing operation described above.

Figure 11:
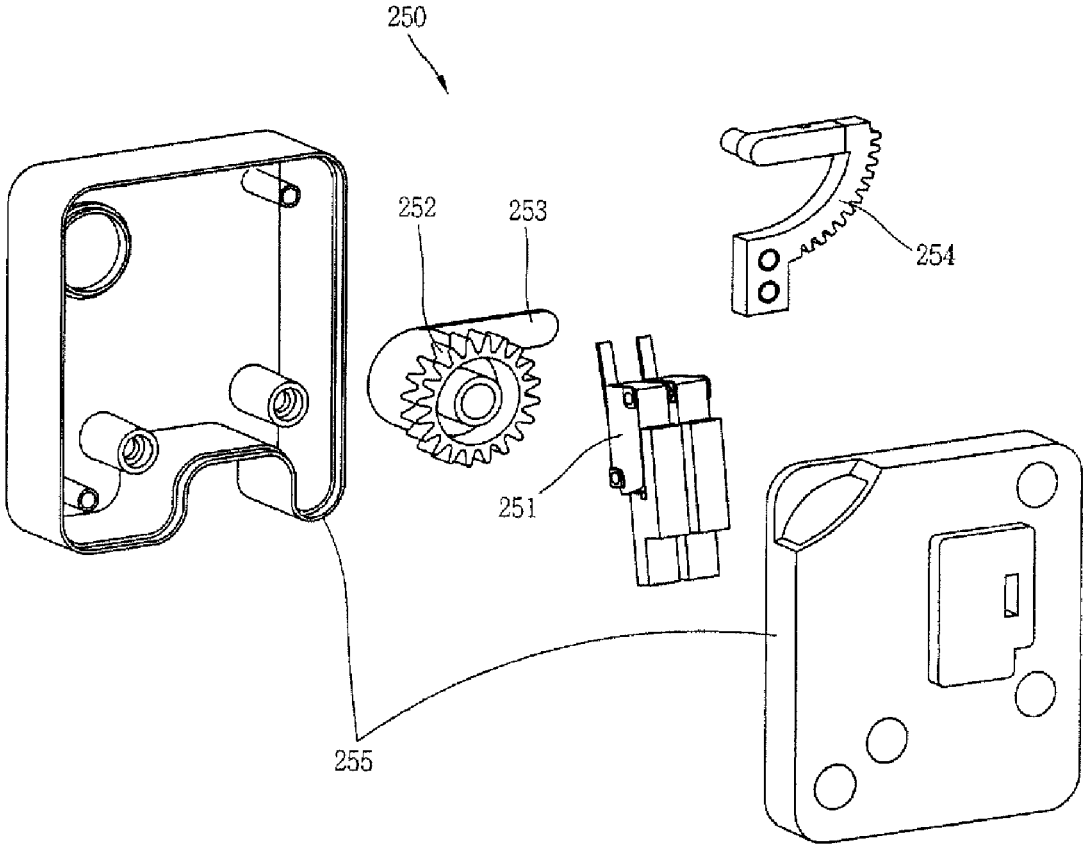
FIG. 11 is an exploded perspective view of a state return unit of the refrigerator.

FIG. 11 illustrates a state return unit of the refrigerator. In the following description, any structure and detailed description that would overlap with those already described above may be similar to the structure described above.

In a refrigerator, a dispenser may have the same construction as that of the dispenser 100, except that the dispenser includes a state return unit 250.

With reference to FIG. 11, in some implementations, the state return unit 250 includes a driving member 254 attached to a dispensing unit and rotated with the dispensing unit, a following member 252 attached to the driving member 254 and rotated thereby, and a return switch 251 that is selectively pressed according to a rotation of the following member 252.

The driving member 254 and the following member 252 may be engaged with each other.

In some examples, the driving member 254 may include the hinge connecting member 115 including the first following gear 131*a*.

The following member 252 includes a pressing portion 253 extending from its outer circumferential surface, and the return switch 251 may be pressed by the pressing portion 253 according to rotation of the following member 252.

The pressing portion 253 may not extend in the direction of a rotational radius from the center of the following member 252. Namely, the pressing unit 253 may be configured according to an installation position of the return switch 251.

The state return unit 250 may further include a casing member 255 in which the following member 252 and the return switch 251 are received. The casing member 255 may be fixed at one side of the dispenser receiving unit 203. In this example, a portion of the following member 252 is exposed from the casing member 255 so as to be connected with the driving member 254.

Figure 12:
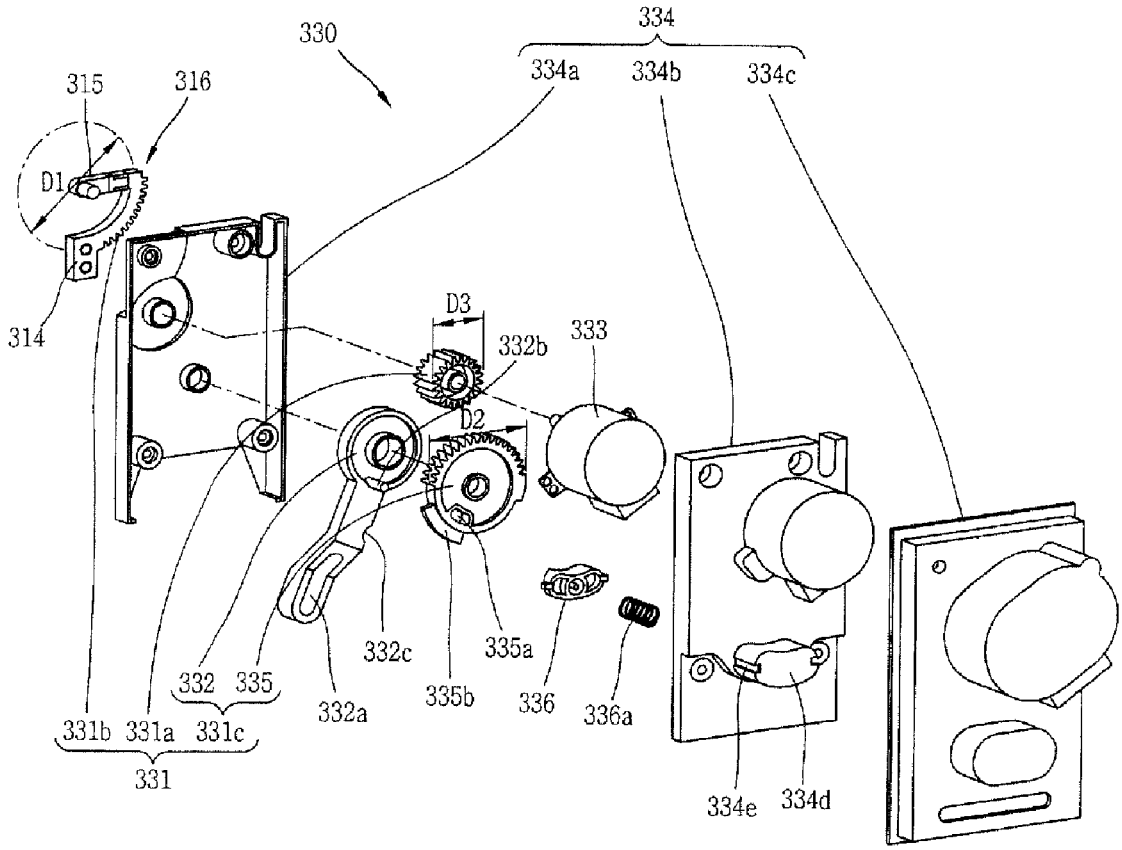
FIG. 12 is an exploded perspective view of a driving unit of the refrigerator.
Figure 13:
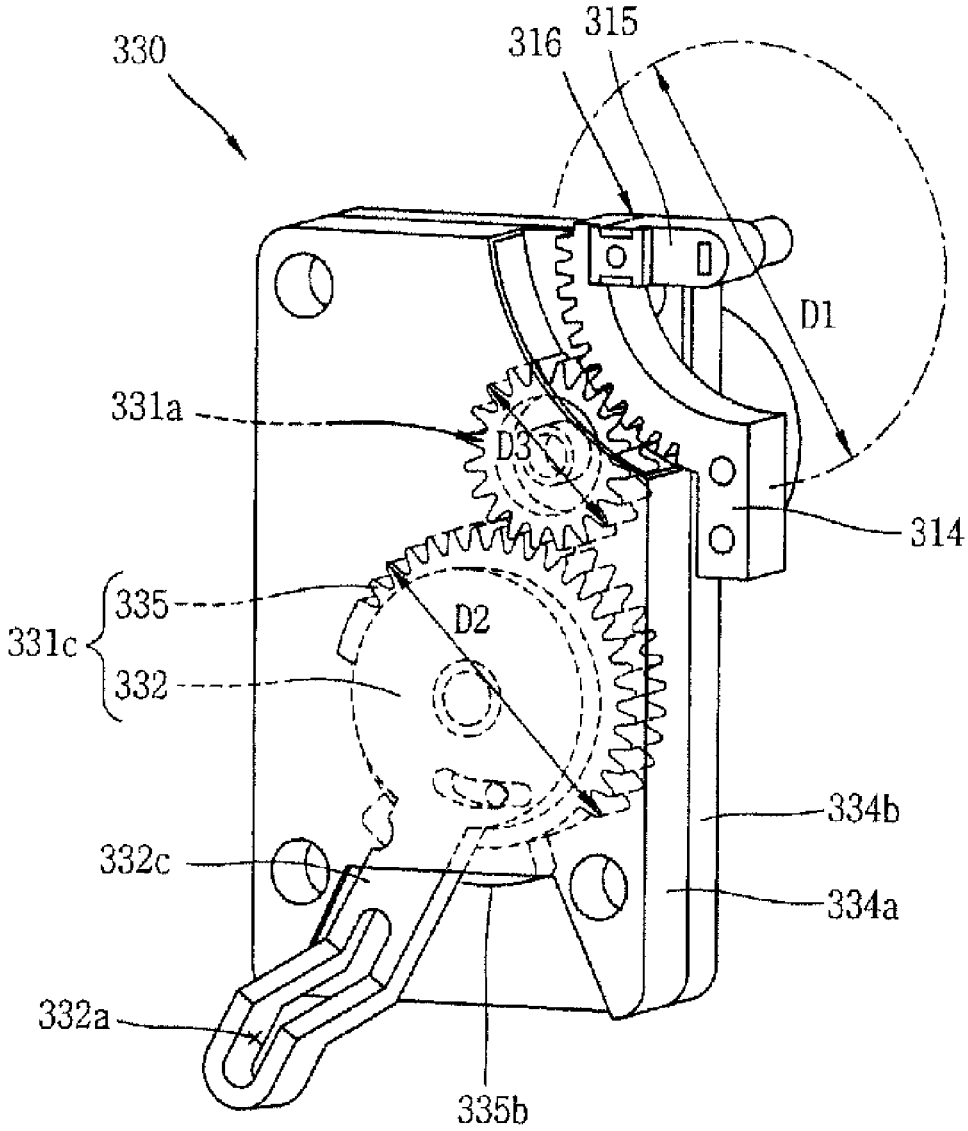
FIG. 13 is a perspective view showing an assembled state of the driving unit in FIG. 12.

FIG. 12 shows a driving unit of the refrigerator, and FIG. 13 shows an assembled state of the driving unit in FIG. 12. In the following description, any structure and detailed description that would overlap with those already described above may be similar to the structure described above.

In a refrigerator, a dispenser may have the same construction as that of the dispenser 100, except that the dispenser includes a driving unit 330.

With reference to FIGS. 12 and 13, in some implementations, the driving unit 330 includes a gear unit 331 having a plurality of gears connected with a dispensing unit and a dispensing button unit, and a motor 333 that transfers power to the gear unit 331.

The gear unit 331 includes a driving gear 331*a* coupled with the motor 333 such that the driving gear 331*a* rotates in response force applied by the motor 333, a first following gear 331*b* engaged with the driving gear 331*a* and adapted to rotate the dispensing unit, and a second following gear 331*c* engaged with the driving gear 331*a* and adapted to move the dispensing button unit.

Here, the driving gear 331*a*, the first following gear 331*b* and the second following gear 331*c* may be installed such that their rotation surfaces are perpendicular to the cover unit 111 (as can be seen from the Figures).

In some examples, a diameter D1 of the first following gear 331*b* is smaller than a diameter D2 of the second following gear 331*c*.

In these examples, the angular velocity of the first following gear 331*b* is larger than that of the second following gear 331*c* according to the rotation of the driving gear 331*a*, so there is a difference between an ejecting speed of the dispensing unit and that of the dispensing button unit. This arrangement may reduce a problem of the movement of the dispensing button unit being interfered with by a cover unit.

In addition, a diameter D3 of the driving gear 331*a* may be smaller than the diameters D1 and D2 of the first following gear 331*b* and the second following gear 331*c*.

The driving gear 331*a* is rotated by the motor 333 and enabling the rotation of the driving gear 331*a* to be maintained at a relatively low speed may allow for the dispensing unit 310 and the dispensing button unit 320 to be smoothly ejected or retracted with minimal noise. The use of a motor having a low rotation speed, however, may be costly and complicated.

Thus, by allowing the driving gear 331*a* to have a smaller diameter, the ejecting speed of the dispensing unit and the dispensing button unit may be reduced by using a rotation speed ratio.

In some implementations, the driving gear 331*a*, the second following gear 331*c* and the motor 333 are positioned within a driving unit frame 334 including the first to third cover units 334*a*, 334*b*, and 334*c* which are attached to each other, and a portion of the driving gear 331*a* is exposed through one portion of the first cover unit 334*a*, where the first following gear 331*b* is engaged.

In these implementations, the second following gear 331*c* may be installed such that its movement is fixed at the dispensing position.

For this, the second following gear 331*c* is rotated by the driving gear 331*a*, and includes a gear body part 335 having a guide recess 335*a* with a certain length in a circumferential direction and a lever unit 332 having a guide protrusion 332*b* inserted in the guide recess 335*a* and extending in a radial direction of the gear body part 335 so as to be slidably engaged with a button frame unit.

A lever fixing unit 336 is elastically supported by an elastic member 336*a* on the driving unit frame 334. A pressing portion 335*b* is positioned at the gear body part 335 and presses the lever fixing unit 336 or releases a pressed state according to a rotation of the gear body part 335. A fixing recess 332*c* is defined at a portion of the side of the lever unit 332 and engages with the lever fixing unit 336 to limit movement of the lever unit 332.

The second cover unit 334*b* includes a fixing unit receiving part 334*d*, in which the lever fixing unit 336 is inserted in response to being pressed by the pressing portion 335*b*, and a guide slot 334*e* defined in a side of the fixing unit receiving part 334*d* in order to guide a receiving direction when the lever fixing unit 336 is received or assist in preventing the lever fixing unit 336 from being released from the second cover unit 334*b*.

In some implementations, the driving unit frame 334 also includes the third cover unit 334*c* in addition to the first cover unit 334*a* and the second cover unit 334*b*, in order to limit the insulator provided at an inner side of the door from passing through the guide slot 334*e* provided at the second cover unit 334*b*.

The pressing portion 335*b* may extend in a radial direction of the gear body part 335 by a certain length of the circumference of the gear body part 335.

The certain length may allow the lever fixing unit 336 to be caught by the fixing recess 332*c* as the pressed state of the lever fixing unit 336 by the pressing portion 335*b* is released when the dispensing button unit is at the dispensing position. The certain length also may allow the pressing portion 335*b* to press the lever fixing unit 336 to enable its release from the fixing recess 332*c* by pressing the lever fixing unit 336 when the dispensing button unit is moved from the dispensing position to the received position. The certain length further may allow the pressing portion 335*b* to maintain the lever fixing unit 336 in the released state at the received position.

Thus, the certain length may be properly selected by the person in the art.

The lever unit 332 extends in its radial direction so as to be slidably combined with the button frame unit.

For this, the lever unit 332 includes a sliding slot 332*a* in the extended direction, and a sliding protrusion extending from the side of the button frame unit is inserted into the sliding slot 332*a*.

Thus, according to a rotation of the second following gear 331*c*, the sliding lever unit 332 pushes the sliding protrusion, and the sliding protrusion is then slid to make a horizontal movement along the sliding slot 332*a*.

The first following gear 331*b* is connected with the hinge connecting portion 315 and a fixing portion 314 to constitute the hinge connecting member 316. The hinge connecting member 116 has a circular arc shape with a certain central angle. One end of the first following gear 331*b* is connected with the hinge connecting portion 315 that is connected with the dispenser receiving part and the other end thereof is connected with the fixing portion 314.

The certain central angle may be larger than the angle at which the cover unit moves.

The fan-shaped internal space defined by connection of the hinge connecting potion 315 and the first following gear 331*b* serves to prevent an upper end of the cover unit from being interfered with by a lower end of a front portion of the dispenser receiving part when the dispensing unit is rotatably ejected.

The first following gear 331*b*, which is provided at one side portion (among the two side portions of the dispensing unit) that is not connected with the driving gear 331*a*, is supported by an idle gear provided at a side portion of the dispenser receiving part and rotates in a corresponding manner with the first following gear 131*a*.

Figure 14:
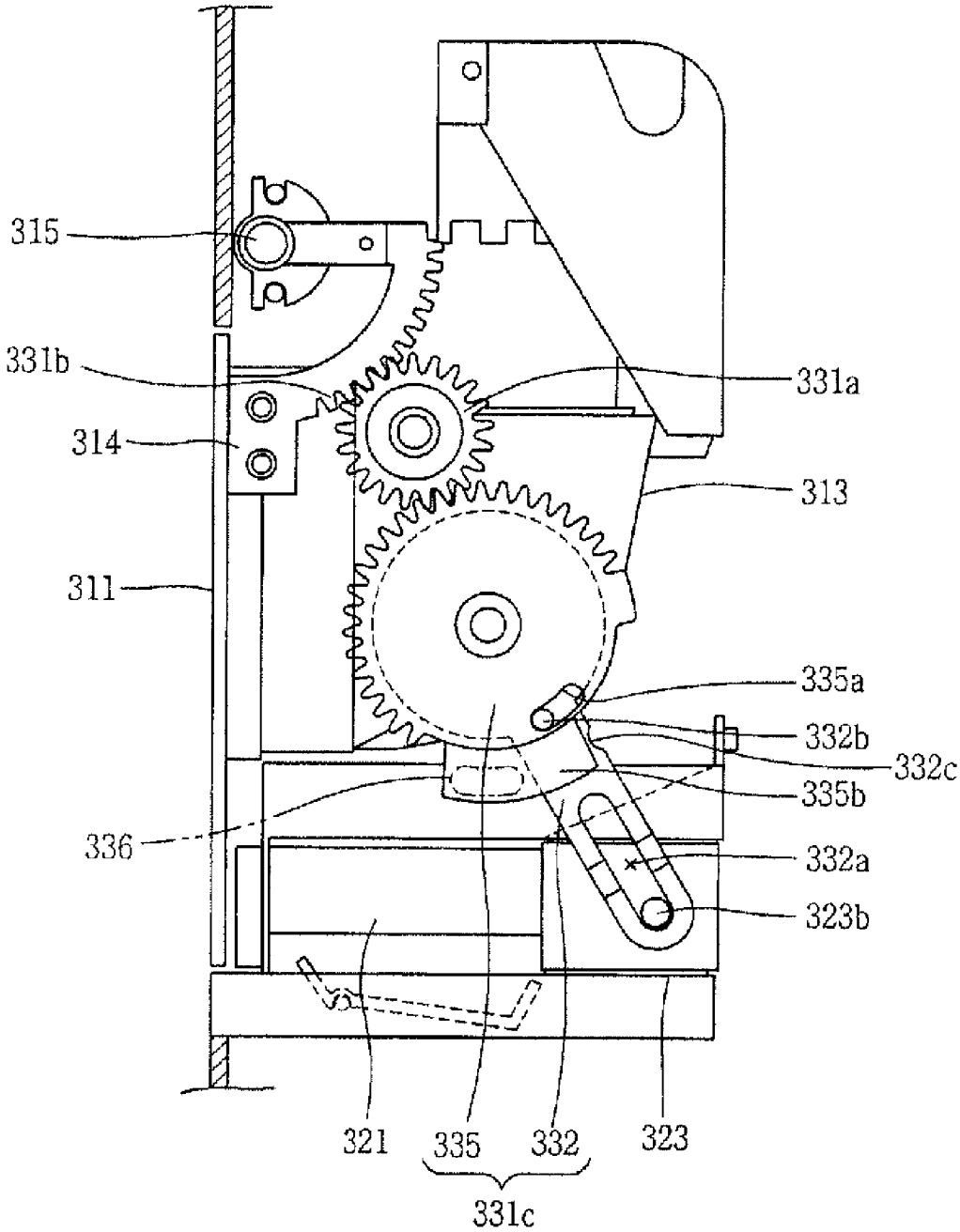
FIG. 14 is a side view of the dispenser at a received position.
Figure 15:
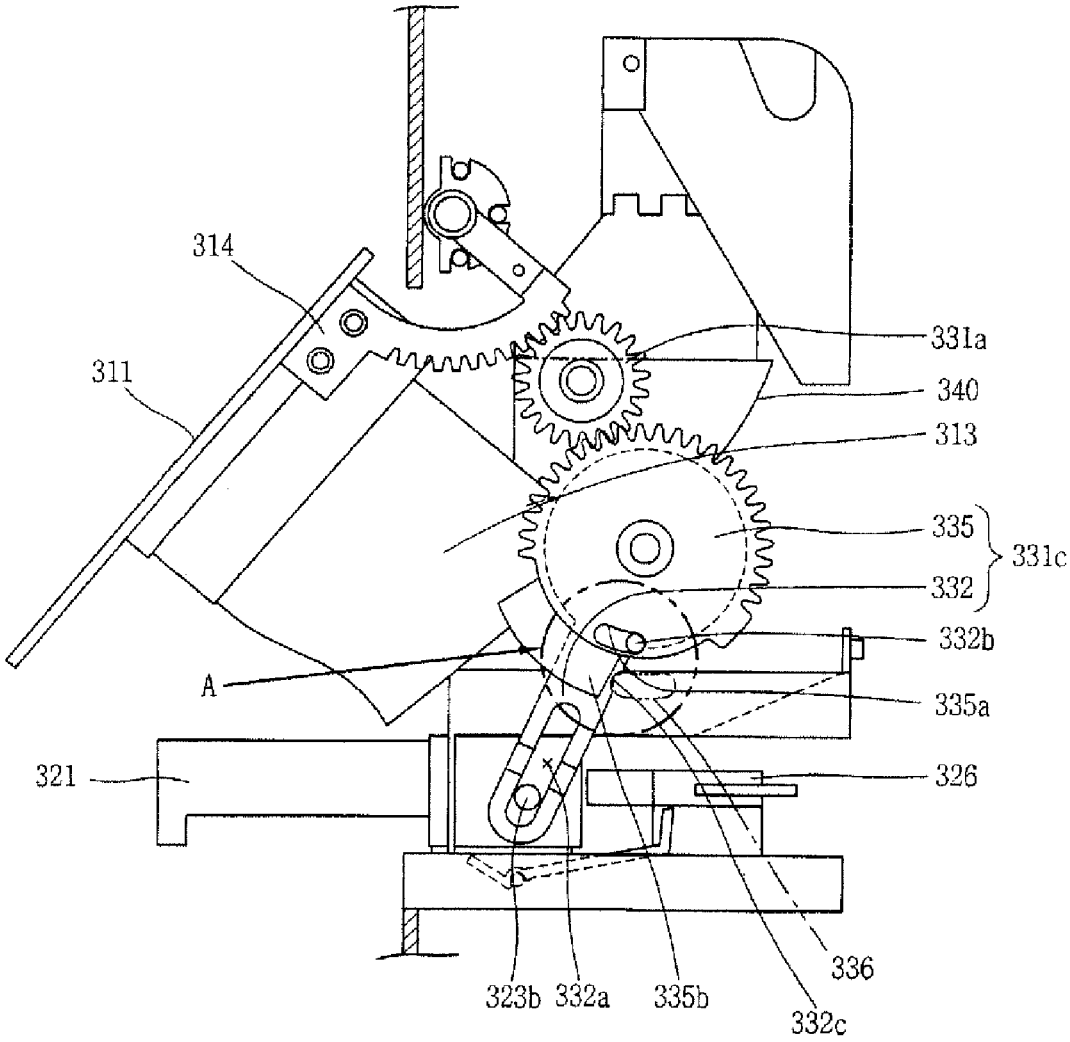
FIG. 15 is a side view of the dispenser at a dispensing position.
Figure 16:
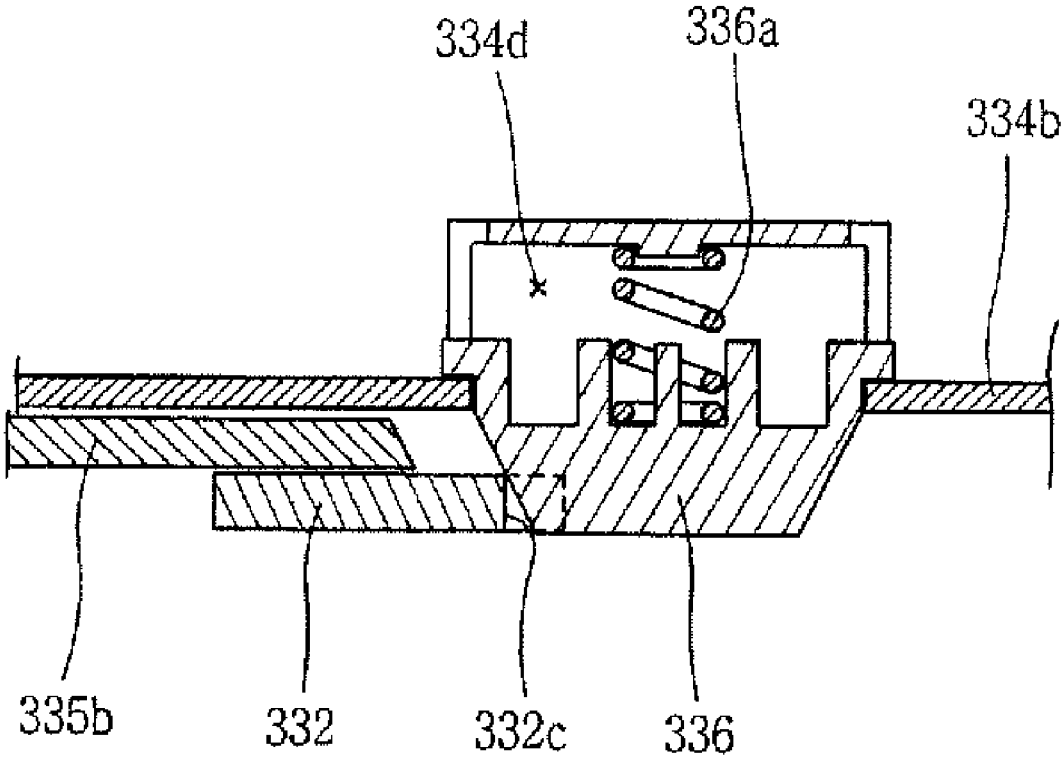
FIG. 16 is an enlarged sectional view of a portion A in FIG. 15.

FIG. 14 illustrates a dispenser at a received, FIG. 15 illustrates a dispenser at a dispensing position, and FIG. 16 is an enlarged sectional view of a portion 'A' in FIG. 15.

With reference to FIGS. 14 to 16, in some implementations, the dispenser is completely shielded by the cover unit 311 at the received position of the door 33 when viewed from an outer side of the refrigerator 30. As such, when the dispenser is not in use, the dispensing unit and the dispensing button unit are received at the inner side of the door and shielded by the cover unit, so that contamination, by dust, etc., of the dispensing unit and the dispensing button unit may be reduced (e.g., prevented). Moreover, when the dispenser is not in use, the cover unit is positioned on the same plane as the front surface of the door, shielding the interior, so that the external appearance of the refrigerator may be aesthetically improved.

As shown in FIG. 14, when the dispenser is in the received position, the guide unit 313 is positioned to overlap with the transfer unit 340, and the dispensing button unit is received to the inner side of the dispenser receiving part by the sliding lever unit 332.

In the received position, when an input signal of the user is transferred via the control butt unit provided at the cover unit 311, the driving gear 331*a* is rotated counterclockwise based on the illustration in FIG. 14 by the motor 333 and the gear body part 335 (including the first following gear 331*b* and the second following gear 331*c*), which is coupled with the driving gear 331*a*, is rotated clockwise.

Accordingly, the cover unit 311 and the guide unit 313 are rotated based on the hinge connecting portion 315 as the axis of rotation so as to be ejected forwardly from the dispenser receiving part.

In addition, as the gear body part 335 is rotated, the guide recess 335*a* is also rotated, and when the guide protrusion 332*b*, which has been positioned at the left end of the guide recess 335*a* based on the depiction in FIG. 14, is positioned at the right end of the guide recess 335*a*, the lever unit 332 is rotated.

Accordingly, the sliding protrusion 323*b* positioned at the button frame unit 323 is horizontally moved, along the sliding slot 332*a* formed at the lever unit 332, to the front side of the dispenser receiving part.

During movement from the received position to the dispensing position, the lever fixing unit 336 remains pressed by the pressing portion 335*b*, and, when the dispenser reaches the dispensing position, the pressing by the pressing portion 335*b* is released and the lever fixing unit 336 is extended and positioned at the right side of the lever unit 332 based on the depiction in FIG. 15. If the lever unit 332 is rotated counterclockwise, it would be caught by the fixing recess 332*c*, so its rotation is limited (e.g., prevented).

Thereafter, when the button unit 321 is pressed by the user, the switching member 326 positioned on the movement path of the button unit 321 is pressed by the button unit 321 to generate an ice dispense signal, a water dispense signal, or the like.

Accordingly, ice, water, or the like is transferred through the transfer unit 340 and dispensed externally through the guide unit 313.

When the dispenser moves from the dispensing position to the received position, the driving gear 331*a* is rotated clockwise by the motor 333 based on the depiction in FIG. 15, and the first following gear 331*b* and the gear body part 335 of the second following gear 331*c*, which are coupled with the driving gear 331*a* are rotated counterclockwise, respectively.

As the gear body part 335 is rotated, the pressing portion 335*b* presses the lever fixing unit 336 and the guide recess 335*a* formed on the gear body part 335 is rotated. When the guide protrusion 332*b*, which has been positioned at the right end of the guide recess 335*a* in FIG. 15, is positioned at the left end of the guide recess 335*a*, the lever unit 332 is rotated. FIG. 16 provides a more detailed view of the interaction of the pressing portion 335*b*, the lever fixing unit 336, and the lever unit 332.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator having a dispenser, comprising:

a cooling compartment;

a door configured to open and close at least a portion of the cooling compartment;

a dispensing unit that is configured to move between a received position at which a dispenser outlet of the dispensing unit is positioned on a side of a surface of the door where the cooling compartment is positioned and a dispensing position at which the dispenser outlet of the dispensing unit is positioned on a side of the surface of the door opposite of the cooling compartment;

a dispenser receiving structure that defines, within the door, a receiving space in which the dispenser outlet is positioned when the dispensing unit is oriented in the received position and that defines, in the surface of the door, an opening through which the dispenser outlet of the dispensing unit passes when the dispensing unit moves from the dispensing position to the received position;

a cover unit that is attached to the dispensing unit and that is configured to cover a portion of the opening defined in the surface of the door by the dispenser receiving structure when the dispensing unit is oriented in the received position;

a driving unit that is configured to move the dispensing unit from the received position to the dispensing position and that is configured to move the dispensing unit from the dispensing position to the received position; and a state return unit that is configured to detect a force applied to the cover unit when the dispensing unit is oriented in the dispensing position and that is configured to, in response to detecting the force applied to the cover unit, cause the driving unit to move the dispensing unit from the dispensing position to the received position;

wherein the dispensing unit comprises:

a guide unit that is attached to a surface of the cover unit positioned closest to the cooling compartment, that defines the dispenser outlet, and that is configured to guide ice through the dispenser outlet when the dispensing unit is oriented in the dispensing position; and a dispensing button unit that is configured to move, in a plane perpendicular to the surface of the door, between a stored position at which the dispensing button unit is positioned on the side of the surface of the door where the cooling compartment is positioned and an extended position at which at least a portion of the dispensing button unit is positioned on the side of the surface of the door opposite of the cooling compartment, the dispensing button unit being configured to, in the extended position, control dispensing of content through the dispenser outlet in response to manipulation of the dispensing button unit, and wherein the dispensing button unit comprises:

a button frame unit that is positioned below the dispensing unit when the refrigerator is oriented in a normal operating orientation and that is configured to move, in the plane perpendicular to the surface of the door, between the stored position at which the button frame unit is positioned on the side of the surface of the door where the cooling compartment is positioned and the extended position at which at least a portion of the button frame unit is positioned on the side of the surface of the door opposite of the cooling compartment; and a button unit that is elastically supported by the button frame unit and that is configured to, when the button frame unit is oriented in the extended position, move, in response to application of force to the button unit, toward the surface of the door from a first position to a second position that is closer to the surface of the door than the first position and move, in response to release of the force applied to the button unit, away from the surface of the door from the second position to the first position.

2. The refrigerator of claim 1, wherein the state return unit comprises a return switch that is actuated by the force applied to the cover unit and that is configured to send a signal to the driving unit in response to being pressed by the force applied to the cover unit.

3. The refrigerator of claim 2, wherein the return switch is pressed as the dispensing unit is moved to the received position by the force applied to the cover unit.

4. The refrigerator of claim 1, wherein the state return unit is a return switch that is positioned within the dispenser receiving structure and pressed by a side of the guide unit when the dispensing unit moves from the dispensing position toward the received position.

5. The refrigerator of claim 1, wherein the driving unit comprises:

a driving gear configured to be driven by a motor;

a first following gear engaged with the driving gear and configured to rotate the dispensing unit from the received position to the dispensing position in response to the driving gear being driven by the motor; and a second following gear engaged with the driving gear and configured to move the dispensing button unit from the stored position to the extended position in response to the driving gear being driven by the motor.

6. The refrigerator of claim 5, wherein the first following gear has a circular arc shape with a central angle of less than 360 degrees being defined between radial axes extending from a rotation axis of the arc and endpoints of the first following gear periphery, a first end of the first following gear is connected at the rotation axis, a second end of the first following gear is connected with the dispensing unit, and the first following gear is configured to rotate about the rotation axis in response to the driving gear being driven by the motor.

7. The refrigerator of claim 5, wherein the second following gear comprises:

a sliding unit that extends in a radial direction and comprises a sliding slot configured to receive a sliding protrusion positioned at a side of the dispensing button unit, the sliding unit being configured to move the dispensing button unit by applying force to the sliding protrusion when the sliding protrusion is received in the sliding slot.

8. The refrigerator of claim 1, wherein the cover unit is configured to rotate about an axis of rotation that is above the cover unit when the refrigerator is oriented in a normal operating orientation.

9. A refrigerator having a dispenser, comprising:

a cooling compartment;

a door configured to open and close at least a portion of the cooling compartment;

a dispensing unit that is configured to move between a received position at which a dispenser outlet of the dispensing unit is positioned on a side of a surface of the door where the cooling compartment is positioned and a dispensing position at which the dispenser outlet of the dispensing unit is positioned on a side of the surface of the door opposite of the cooling compartment;

a dispenser receiving structure that defines, within the door, a receiving space in which the dispenser outlet is positioned when the dispensing unit is oriented in the received position and that defines, in the surface of the door, an opening through which the dispenser outlet of the dispensing unit passes when the dispensing unit moves from the dispensing position to the received position;

a cover unit that is attached to the dispensing unit and that is configured to cover a portion of the opening defined in the surface of the door by the dispenser receiving structure when the dispensing unit is oriented in the received position;

a driving unit that is configured to move the dispensing unit from the received position to the dispensing position and that is configured to move the dispensing unit from the dispensing position to the received position; and a state return unit that is configured to detect a force applied to the cover unit when the dispensing unit is oriented in the dispensing position and that is configured to, in response to detecting the force applied to the cover unit, cause the driving unit to move the dispensing unit from the dispensing position to the received position, wherein the cover unit is configured to rotate about an axis of rotation that is above the cover unit when the refrigerator is oriented in a normal operating orientation, and wherein the state return unit comprises:

a driving member attached to at least one of the cover unit and the guide unit and rotated with the cover unit and the guide unit when the cover unit and the guide unit move from the dispensing position toward the received position;

a following member connected with the driving member and rotated by the driving member; and a return switch that is pressed in response to the rotation of the following member that occurs when the cover unit and the guide unit move from the dispensing position toward the received position.

10. The refrigerator of claim 9, wherein the return switch is pressed by a pressing portion that extends from an outer circumferential surface of the following member.

11. The refrigerator of claim 9, wherein the driving member and the following member are gears engaged with each other.

12. The refrigerator of claim 9, wherein the following member and the return switch are received in a casing member provided at one side of the dispenser receiving unit, and a portion of the following member is exposed from the casing member to enable connection with the driving member.

13. The refrigerator of claim 1, wherein the cover unit is positioned in a plane of the surface of the door when the dispensing unit is oriented in the received position.

14. A refrigerator having a dispenser, comprising:

a cooling compartment;

a door configured to open and close at least a portion of the cooling compartment;

a dispensing unit that is configured to move between a received position at which a dispenser outlet of the dispensing unit is positioned on a side of a surface of the door where the cooling compartment is positioned and a dispensing position at which the dispenser outlet of the dispensing unit is positioned on a side of the surface of the door opposite of the cooling compartment; a button frame unit that is positioned within a receiving space defined within the door when the dispensing unit is oriented in the received position, that is covered by the dispensing unit when the dispensing unit is oriented in the received position, and that is configured to move, in a plane perpendicular to the surface of the door, between a stored position at which the button frame unit is positioned on the side of the surface of the door where the cooling compartment is positioned and an extended position at which at least a portion of the button frame unit is positioned on the side of the surface of the door opposite of the cooling compartment;

a button unit that is elastically supported by the button frame unit and that is configured to, when the button frame unit is oriented in the extended position, move, in response to application of force to the button unit, toward the surface of the door from a first position to a second position that is closer to the surface of the door than the first position and move, in response to release of the force applied to the button unit, away from the surface of the door from the second position to the first position, the button unit being configured to cause the dispensing unit to dispense content through the dispenser outlet when the button unit is moved to the second position; and a driving unit that is configured to guide movement of the button frame unit and that is configured to fix movement of the button frame unit when the button frame unit is oriented in the extended position, wherein the driving unit comprises:

a driving unit frame in which a motor having a driving gear is positioned;

a first following gear that is attached to the dispensing unit and that is configured rotate the dispensing unit from the received position to the dispensing position in response to rotation of the driving gear;

a second following gear configured to move the button frame unit, in the plane perpendicular to the surface of the door, from the stored position to the extended position in response to rotation of the driving gear; and a lever fixing unit elastically supported by the driving unit frame and configured to fix movement of the second following gear, and wherein the second following gear comprises:

a gear body part engaged with the driving gear and having a guide groove having a certain length in a circumferential direction, the certain length being less than a circumference of the gear body part; and a lever unit having a guide protrusion that is inserted in the guide groove and that is configured to be guided along the guide groove, the lever unit extending in a radial direction of the gear body part and connected with the button frame unit such that movement of the lever unit causes movement of the button frame unit.

15. The refrigerator of claim 14, wherein the lever unit comprises a sliding slot in which a sliding protrusion positioned at a side of the button frame unit is inserted, the lever unit being configured to move the button frame unit by applying force to the sliding protrusion when the sliding protrusion is inserted in the sliding slot.

16. The refrigerator of claim 15 further comprising a pressing unit, wherein the lever fixing unit restricts movement of the lever unit based on a pressing state of the pressing unit, the pressing state of the pressing unit being based on rotation of the gear body part.

17. The refrigerator of claim 16, wherein, when the lever unit is at the extended position, the pressing unit releases a pressed state of the lever fixing unit and thereby fixes movement of the button frame unit.

18. The refrigerator of claim 14, wherein the lever fixing unit is positioned at a fixing recess located at a portion of a side of the lever unit to prevent the lever unit from moving from the extended position to the stored position.

19. The refrigerator of claim 14, wherein the diameter of the first following gear is smaller than the diameter of the second following gear.

20. The refrigerator of claim 14, wherein the first following gear has a circular arc shape with a central angle of less than 360 degrees being defined between radial axes extending from a rotation axis of the arc and endpoints of the first following gear periphery, a first end of the first following gear is connected at the rotation axis, a second end of the first following gear is connected with the dispensing unit, and the first following gear is configured to rotate about the rotation axis in response to the driving gear being driven by the motor.

21. The refrigerator of claim 8, wherein the state return unit comprises:

a driving member attached to at least one of the cover unit and the guide unit and rotated with the cover unit and the guide unit when the cover unit and the guide unit move from the dispensing position toward the received position;

a following member connected with the driving member and rotated by the driving member; and a return switch that is pressed in response to the rotation of the following member that occurs when the cover unit and the guide unit move from the dispensing position toward the received position.

22. The refrigerator of claim 21, wherein the return switch is pressed by a pressing portion that extends from an outer circumferential surface of the following member.

23. The refrigerator of claim 21, wherein the driving member and the following member are gears engaged with each other.

24. The refrigerator of claim 21, wherein the following member and the return switch are received in a casing member provided at one side of the dispenser receiving unit, and a portion of the following member is exposed from the casing member to enable connection with the driving member.

* * * * *